US012114784B2

(12) United States Patent
Sugano et al.

(10) Patent No.: US 12,114,784 B2
(45) Date of Patent: Oct. 15, 2024

(54) CHAIR HAVING A MOVABLE SEAT

(71) Applicant: KOKUYO CO., LTD., Osaka (JP)

(72) Inventors: Takao Sugano, Osaka (JP); Yojiro Kinoshita, Osaka (JP); Katsuaki Hayashi, Osaka (JP)

(73) Assignee: KOKUYO CO., LTD., Osaka (JP)

( * ) Notice: Subject to any disclaimer, the term of this patent is extended or adjusted under 35 U.S.C. 154(b) by 133 days.

(21) Appl. No.: 17/946,370

(22) Filed: Sep. 16, 2022

(65) Prior Publication Data

US 2023/0103950 A1 Apr. 6, 2023

(30) Foreign Application Priority Data

Oct. 1, 2021 (JP) ..... 2021-162893

(51) Int. Cl.
*A47C 1/032* (2006.01)
*A47C 3/026* (2006.01)
*A47C 3/18* (2006.01)

(52) U.S. Cl.
CPC ..... *A47C 3/026* (2013.01); *A47C 1/03261* (2013.01); *A47C 1/03288* (2013.01); *A47C 3/18* (2013.01)

(58) Field of Classification Search
CPC ..... A47C 1/032; A47C 3/026; A47C 1/03288; A47C 1/03261; A61G 5/1081
USPC ..... 297/314, 461
See application file for complete search history.

(56) References Cited

U.S. PATENT DOCUMENTS 144,664 A * 11/1873 Doremus ..... F16F 15/08 248/632
1,358,640 A * 11/1920 Koyama ..... A47C 9/002 297/302.4 X
2,132,291 A * 10/1938 Fitos ..... A47C 9/002 297/314 X
2,184,988 A * 12/1939 Collier ..... A47C 3/026 248/575
2,796,920 A * 6/1957 Cowles ..... A47C 7/448 297/452.33
3,259,431 A * 7/1966 Gale ..... A47C 3/12 297/302.1 X (Continued)

FOREIGN PATENT DOCUMENTS

DE 10311998 A1 9/2004
DE 202009011135 U1 11/2009

(Continued)

OTHER PUBLICATIONS

Extended European Search Report dated Feb. 10, 2023, issued in counterpart EP Application No. 22197052.8. (8 pages).

*Primary Examiner* — Rodney B White
(74) *Attorney, Agent, or Firm* — WHDA, LLP

(57) ABSTRACT

In the chair, a space between swinging surfaces facing each other can be appropriately unseen. The chair includes swinging surfaces (rolling surfaces) (312*a*) and (322*a*) facing each other and has a configuration in which the swinging surfaces (312*a*) and (322*a*) swings with respect to each other in directions of 360 degrees including front-rear and left-right directions. In such a chair, an elastic member (33) is arranged to be positioned between the swinging surfaces (312*a*) and (322*a*) at least in the vicinity of outer peripheral edges (312*z*) and (322*z*), and a stretchable sheet material (60) is provided between the outer peripheral edges (312*z*) and (322*z*) to conceal a gap between the swinging surfaces (312*a*) and (322*a*) facing each other, the gap including the elastic member (33).

7 Claims, 25 Drawing Sheets

(56) References Cited

U.S. PATENT DOCUMENTS 3,309,137 A * 3/1967 Wiebe ..... A47C 3/18 297/302.1
3,813,069 A * 5/1974 Fletcher ..... A47C 3/026 248/188.1
3,863,982 A * 2/1975 Sandham ..... A47C 7/448 297/302.1 X
4,099,697 A * 7/1978 Von Schuckmann .... A47C 3/30 297/314 X
4,372,606 A * 2/1983 Faull ..... A47C 3/025 297/313
4,598,946 A * 7/1986 Cone ..... A47D 13/107 297/258.1 X
4,605,334 A * 8/1986 Kalvatn ..... F16C 11/00 297/314 X
4,871,208 A * 10/1989 Hodgdon ..... A47C 3/026 248/575
4,890,886 A * 1/1990 Opsvik ..... A47C 7/448 297/313 X
4,974,904 A * 12/1990 Phillips ..... A47C 9/002 297/258.1
5,590,930 A * 1/1997 Glockl ..... A47C 3/0257 297/258.1 X
5,649,740 A * 7/1997 Hodgdon ..... A47C 1/03288 248/575
5,728,049 A * 3/1998 Alberts ..... A47C 9/002 297/314 X
5,769,492 A * 6/1998 Jensen ..... A47C 9/002 297/314 X
6,033,021 A * 3/2000 Udo ..... A47C 9/002 297/314 X
6,176,548 B1 * 1/2001 Thole ..... A47C 9/002 297/329
6,209,958 B1 * 4/2001 Thole ..... A47C 3/026 297/325
6,481,795 B1 * 11/2002 Pettibon ..... A47C 3/18 297/314 X
6,523,895 B1 * 2/2003 Vogtherr ..... A47C 3/026 297/300.1
6,685,268 B2 * 2/2004 Meyer ..... A47C 9/002 297/314 X
6,688,689 B1 * 2/2004 Thorn ..... A47C 7/14 297/314 X
6,863,017 B2 * 3/2005 Charles ..... B60N 2/2839 297/314 X
7,063,386 B2 * 6/2006 Dowty ..... B64D 11/0636 297/314 X
7,100,983 B1 * 9/2006 Gant ..... A47C 3/025 297/314 X
7,396,080 B2 * 7/2008 Suhr ..... A47C 7/14 297/313
7,547,067 B2 * 6/2009 Keilhauer ..... A47C 3/02 297/314 X
7,789,463 B2 * 9/2010 Gang ..... A47C 9/002 297/314 X
7,806,479 B2 * 10/2010 Jensen ..... A47C 9/002 297/258.1 X
7,922,247 B2 * 4/2011 Dickie ..... A47C 7/14 297/314 X
7,938,487 B2 * 5/2011 Fismen ..... A47C 3/0252 297/302.6
7,938,489 B2 * 5/2011 Nazari ..... A47C 3/0257 297/258.1
8,888,184 B2 * 11/2014 Meyer ..... A47C 1/03255 297/258.1 X
9,060,612 B2 * 6/2015 Lee ..... A47C 9/002
9,211,013 B2 * 12/2015 Harrison ..... A47C 7/448
9,289,067 B2 * 3/2016 Meyer ..... A47C 7/14
9,398,811 B1 * 7/2016 Williams ..... A47C 3/12
9,439,513 B2 * 9/2016 Walser ..... A47C 7/004
9,629,465 B2 * 4/2017 Williams ..... A47C 3/18
9,839,296 B2 * 12/2017 Ballendat ..... A47C 7/44
10,226,127 B2 * 3/2019 Harrison ..... A47C 7/448
10,772,427 B2 * 9/2020 Schuppler ..... A47C 7/44
11,097,153 B1 * 8/2021 Lee ..... A63B 22/18
11,103,072 B2 * 8/2021 Rheault ..... A47C 9/007
11,439,235 B2 * 9/2022 Taylor, II ..... A47C 7/14
11,540,637 B2 * 1/2023 Sugano ..... A47C 7/142
11,812,865 B2 * 11/2023 Costaglia ..... A47C 9/002
2002/0043846 A1 * 4/2002 Brauning ..... A47C 7/448 297/314
2007/0102979 A1 * 5/2007 Tedesco ..... A47C 3/30 297/461
2007/0241599 A1 * 10/2007 Hodgdon ..... A47C 1/023 297/313
2012/0292968 A1 11/2012 Lee

FOREIGN PATENT DOCUMENTS

DE 202012001811 U1 5/2013
JP 2009-82521 A 4/2009
JP 2009-297319 A 12/2009

* cited by examiner

CHAIR HAVING A MOVABLE SEAT

CROSS-REFERENCE TO RELATED APPLICATIONS

This application claims priority of Japanese Patent Applications No. 2021-162893 filed on Oct. 1, 2021. The contents of the applications are incorporated herein by reference in their entirety

BACKGROUND

Field of the Invention

The present invention relates to a chair that is suitably utilized in an office or the like and is movable in front-rear, left-right, and diagonal directions.

Description of the Related Documents

For example, chairs having a seat that is tiltable in front-rear, left-right, and diagonal directions include chairs known from Japanese Unexamined Patent Application Publication No. 2009-82521 and Japanese Unexamined Patent Application Publication No. 2009-297319 (hereinafter referred to as Patent Documents 1 and 2).

Patent Document 1 describes a configuration in which a plurality of fluid bags are connected by a flow path and a seat is tilted when air moves.

Patent. Document 2 describes a configuration in which a plurality of independent air cushions are covered with a cover member and fitted into a recess of a seat to provide a cushioning property to a person sitting in the chair.

In the configurations of Patent Documents 1 and 2, the seat can move freely by the cushioning effect. However; the degree of freedom of deformation of the seat is too high for a seated person to hold his or her posture on the seat, and therefore, the seated person needs to follow a movement of the seat rather than the seat following a movement of the seated person. As a result, the conventional seats are not designed suitably for supporting a movement of the seated person continuously changing his or her posture while the seated person balances his or her load.

To solve such a problem, it is conceivable to provide rolling surfaces facing each other to allow the rolling surfaces to roll in directions of 360 degrees, and to swingable attach a seat to the upper one of the rolling surfaces.

In a configuration having such rolling surfaces facing each other, it:

is necessary to hide a space between the rolling surfaces from the viewpoint of preventing the intrusion of foreign bodies and the appearance of the design. However, a structure that hides the space between such surfaces facing each other in a chair is not commonly known. Such a problem is not limited to a case where surfaces facing each other contact each other, but: is also widely common to a structure that hides a space between swinging surfaces facing each other.

The present invention has been made by focusing on such a problem, and an object thereof is to realize an unprecedented chair in which a space between swinging surfaces facing each other can be appropriately hidden.

SUMMARY

The present invention adopts the following means to achieve such an object.

That is, a chair of the present invention includes swinging surfaces facing each other, and the swinging surfaces swings with respect: to each other in a direction of 360 degrees including front: rear and left-right directions. In the chair, an elastic member is arranged between the swinging surfaces at least in a vicinity of outer peripheral edges of the swinging surfaces, and a stretchable sheet: material is provided between the outer peripheral edges to conceal a gap between the swinging surfaces facing each other, the gap including the elastic member, Normally, when covering swinging surfaces facing each other, a wide range including the swinging surfaces is covered by a cover and the cover is fixed to an appropriate location. In contrast, according to the present invention, the stretchable sheet material is only arranged between outer peripheral edges of the swinging surfaces facing each other, so that it is possible to conceal only a location that needs to be concealed. The elastic member is arranged between the swinging surfaces, and the stretchable sheet material conceals a space between the swinging surfaces, the space including the elastic member. Therefore, the stretchable sheet material and the elastic member have a function of preventing foreign bodies from entering the space between the swinging surfaces, and additionally, the elastic member prevents the stretchable sheet material from loosening or forming wrinkles, and the stretchable sheet material has a function of preventing the elastic member from protruding from the gap.

To maintain an appropriate appearance of the stretchable sheet material, it is desirable that a size and an elasticity of the stretchable sheet material are chosen so that no wrinkles are generated when the gap is narrow and an operation of the swinging surfaces is not hindered when the gap is wide.

To evenly cover a periphery of the gap, it is desirable that the stretchable sheet material has a tubular shape. In this case, in addition to a stretchable sheet material formed into a tubular shape by sewing, the stretchable sheet material may be formed into a tubular shape from the beginning.

To further improve the ability of a cover member to follow the movement, it is desirable that the cover member deforms to follow the movement of the gap between the swinging surfaces.

The above-described structure is particularly useful when applied to a chair in which surfaces facing each other contact each other via the elastic member, and at least one of the surfaces is a rolling surface curved to change a contract portion while swinging.

To effectively achieve the above-described effect, it is desirable that the elastic member is a thick elastic member that is also arranged at an inner side from the vicinity of the outer peripheral edges of the swinging surfaces.

To obtain a configuration in which components can be easily mounted and are not easily detached by swinging, it is desirable to provide, in a vicinity of the outer peripheral edges of the swinging surfaces facing each other, grooves extending along the outer peripheral edges and opening in opposite directions, provide a cover member in which deformable strips are attached to edge portions of the stretchable sheet material, and push the strips into the grooves to conceal the gap between the swinging surfaces facing each other by the cover member.

To easily attach the cover member and easily maintain a stereoscopic shape, it is desirable that each of the grooves forms a pair together with a different one end of the strips.

The present invention has the configuration described above, and thus, it is possible to provide an unprecedented chair in which a space between swinging surfaces facing each other can be appropriately hidden.

DETAILED DESCRIPTION

An embodiment of the present invention will be described below with reference to the drawings.

Figure 1:
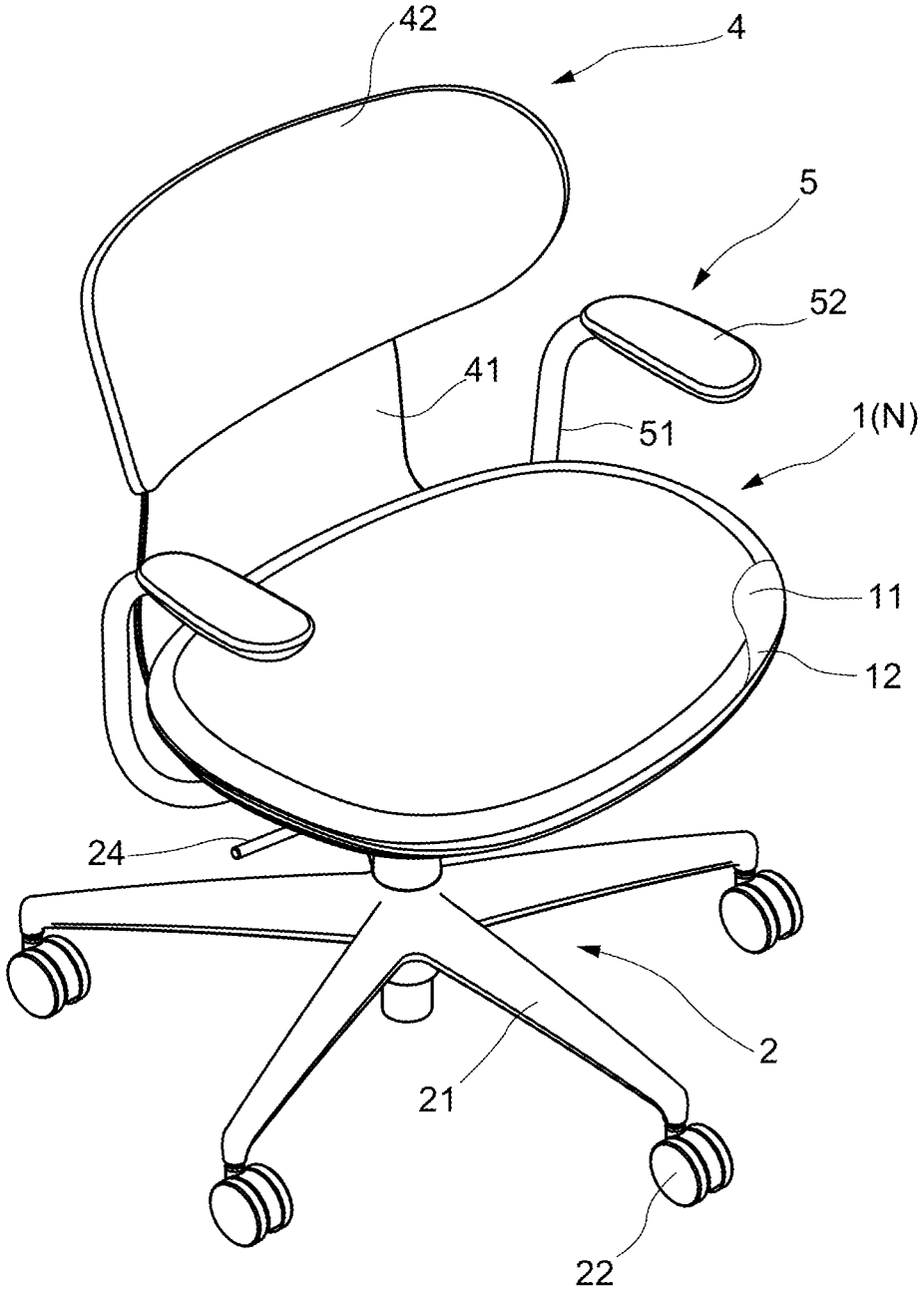
FIG. 1 is a perspective view of a chair according to an embodiment of the present invention.
Figure 2:
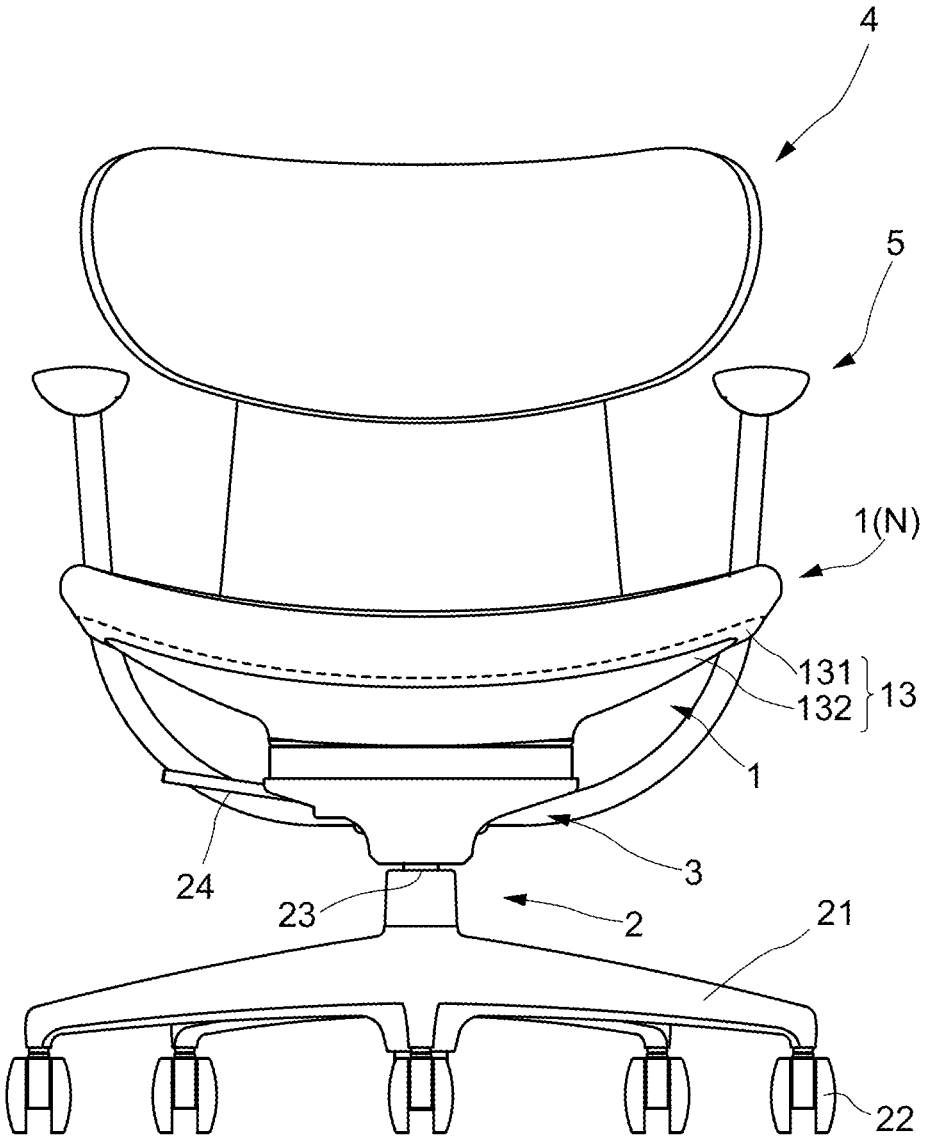
FIG. 2 is a front view of the chair.
Figure 3:
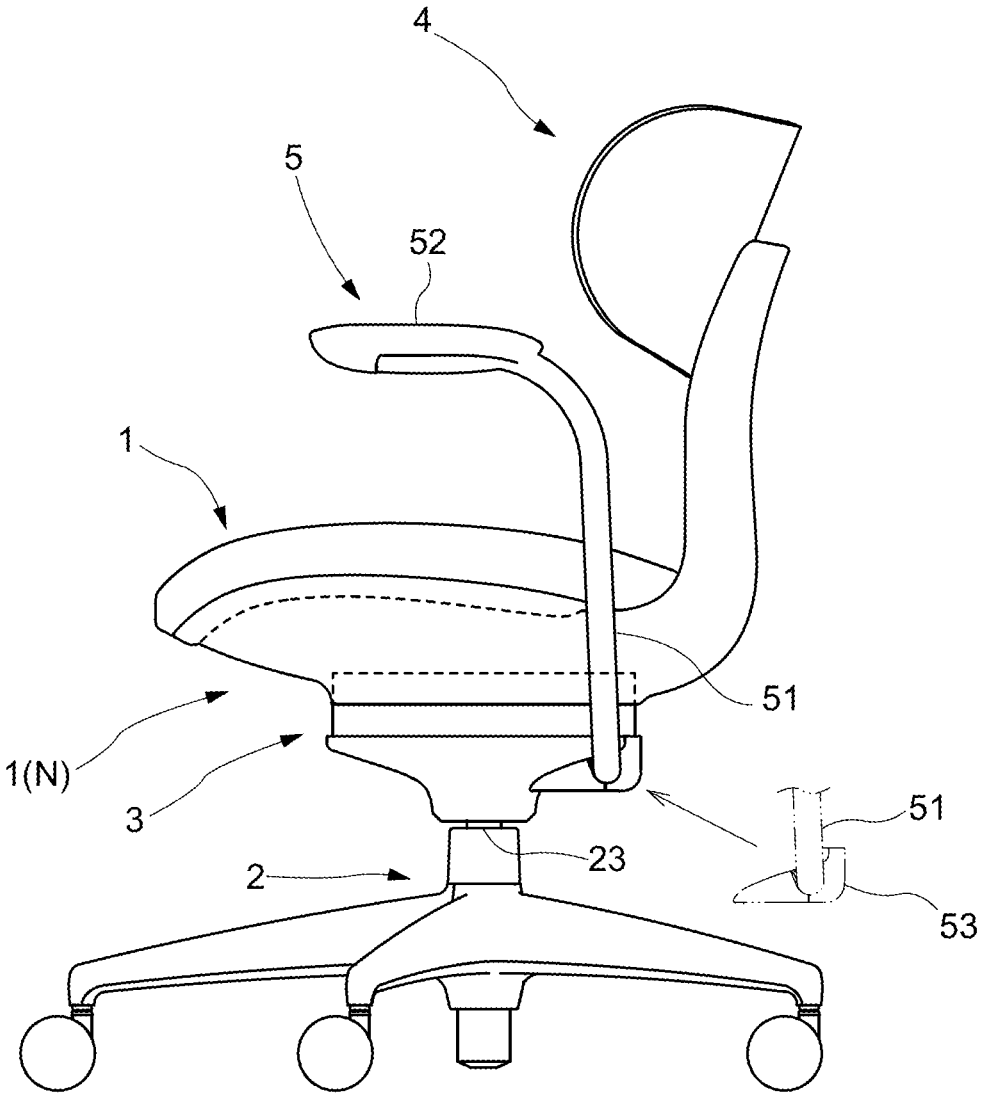
FIG. 3 is a right side view of the chair.
Figure 4:
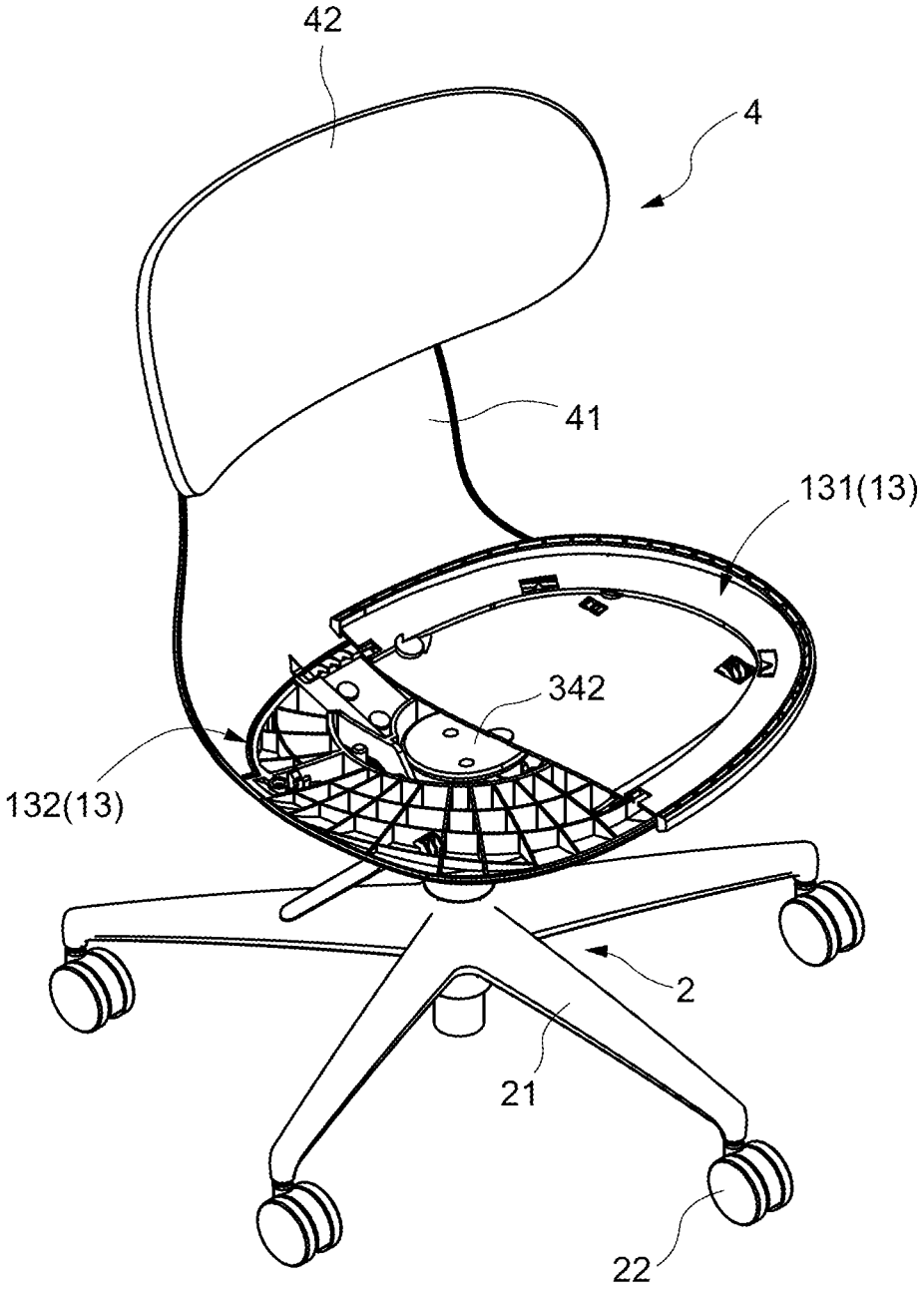
FIG. 4 is a perspective view illustrating the chair in which a part of a seat is omitted.
Figure 5:
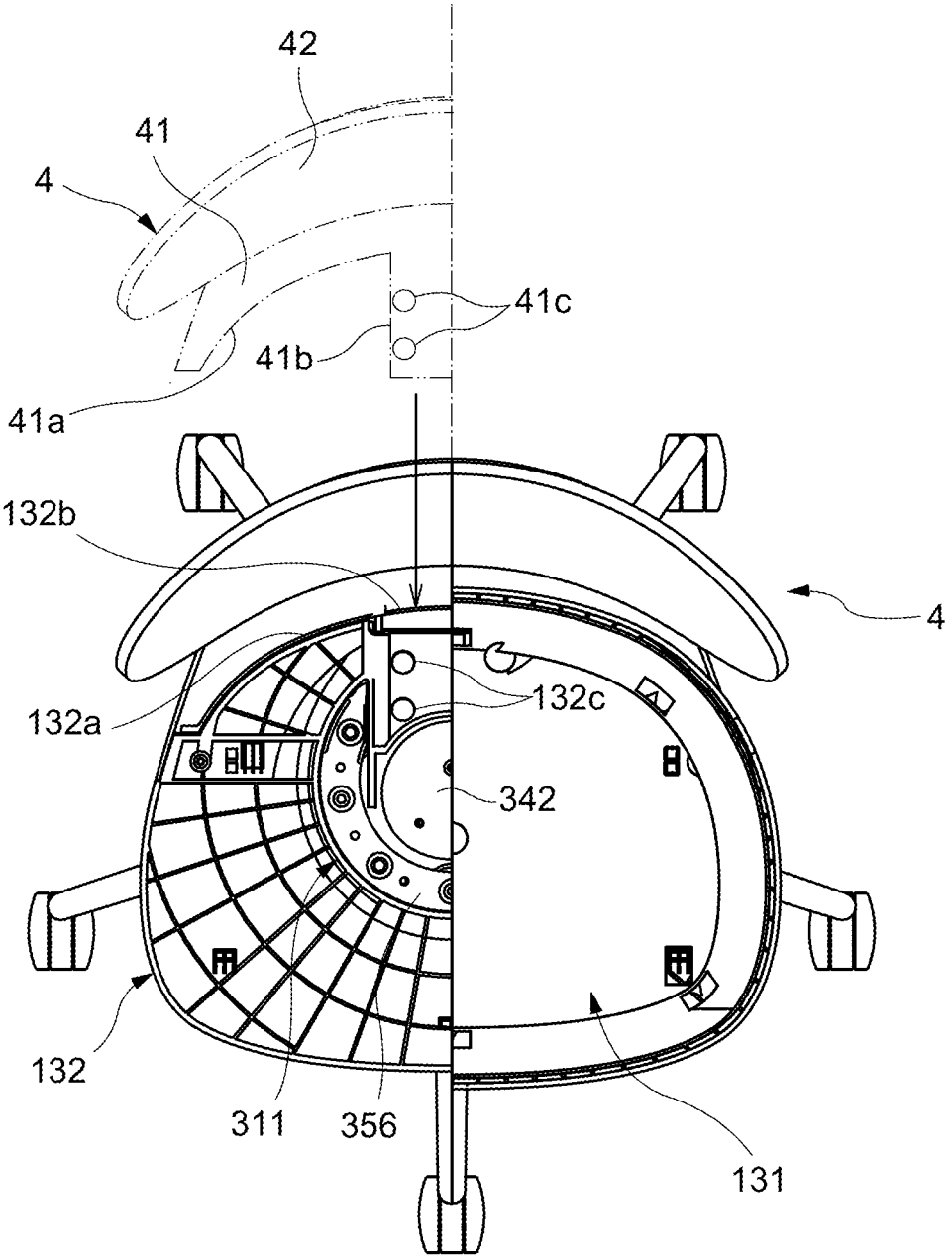
FIG. 5 is a plan view illustrating the chair in which a part of the seat is omitted.
Figure 17:
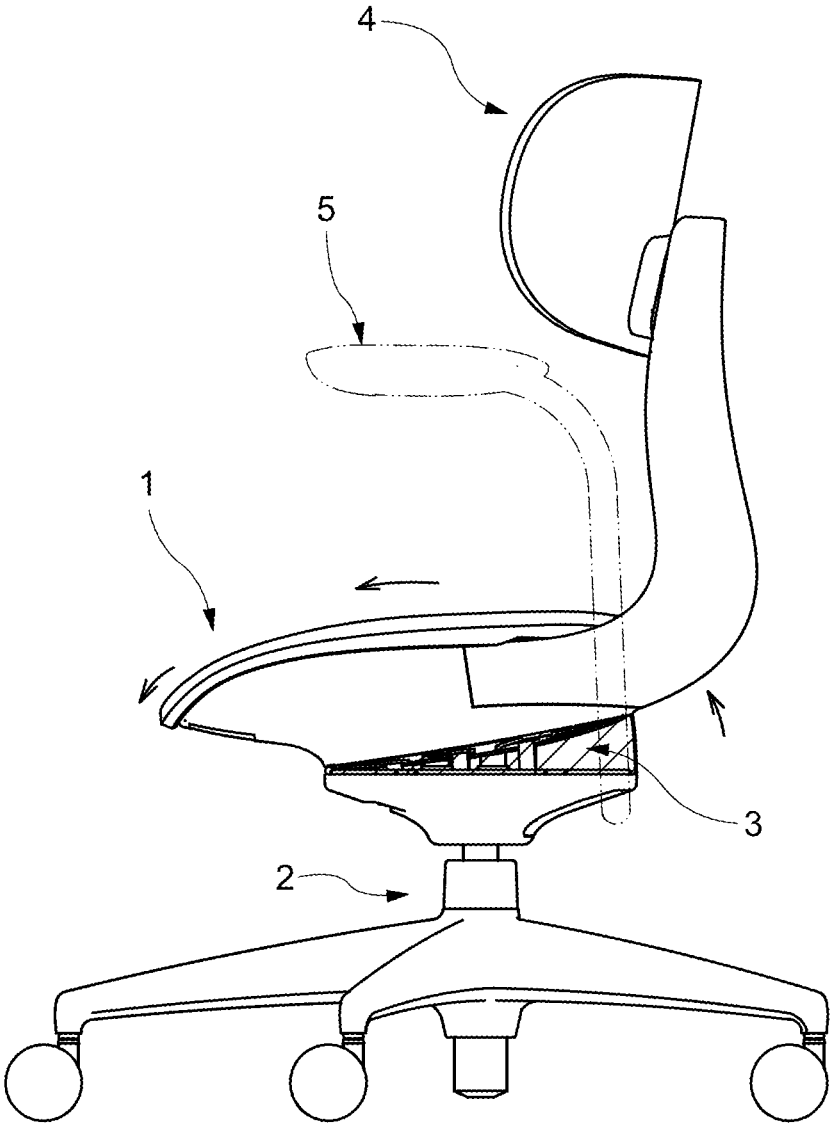
FIG. 17 is a right: side view illustrating a state where the seat is tilted forward.
Figure 18:
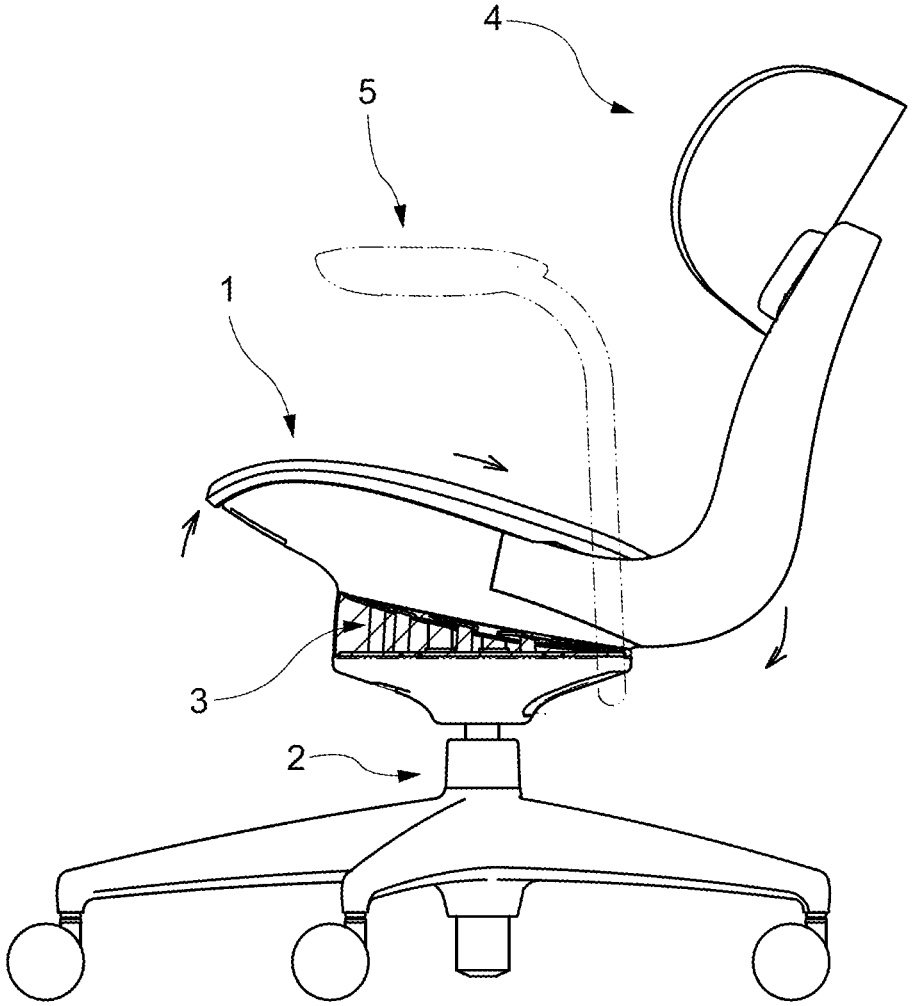
FIG. 18 is a right: side view illustrating a state where the seat is tilted rearward.
Figure 22:
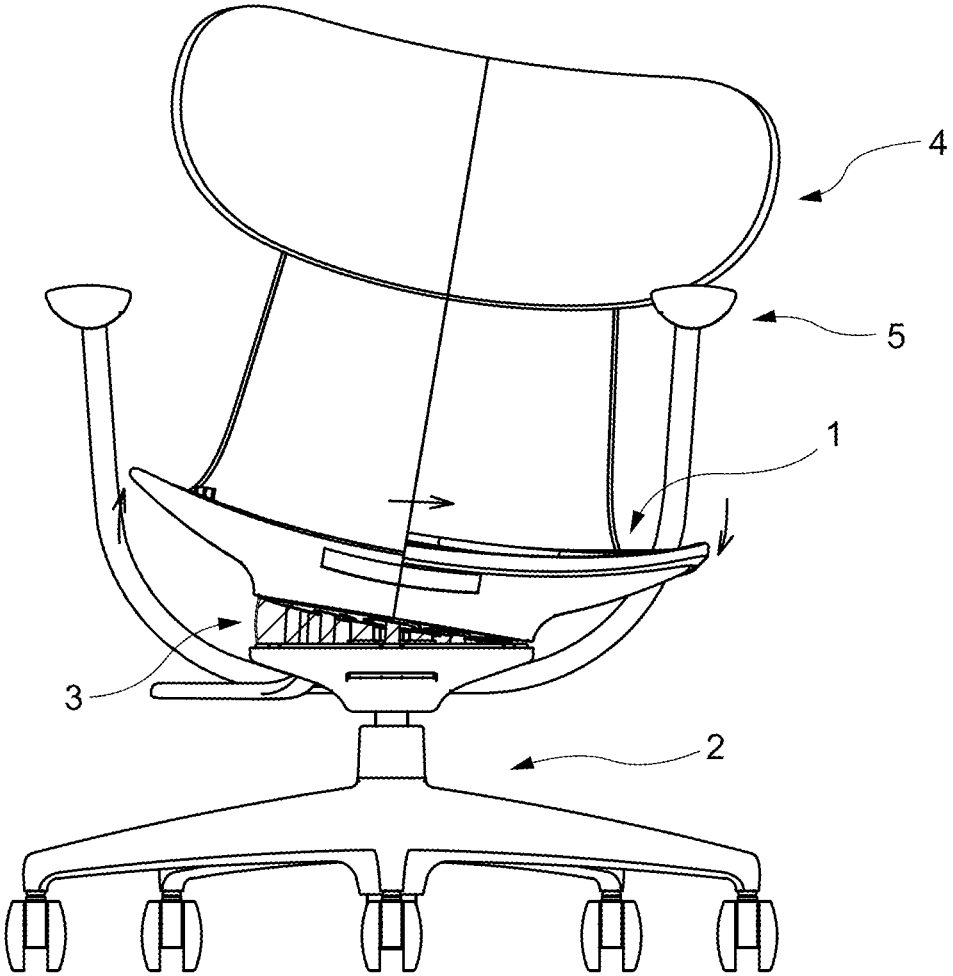
FIG. 22 is a front view illustrating a state where the seat is tilted to the left and right.

FIGS. 1 to 3 illustrate an outer appearance of a chair according to the embodiment, and FIGS. 4 and 5 illustrate views in which a part of a seat 1 is omitted. As illustrated in the drawings, in the chair, a movement mechanism 3 is provided as a movable support between the seat 1 and a leg 2, a back 4 is attached to move integrally with the seat 1, and arms 5 are attached not to move integrally with the seat 1 and the back 4. FIGS. 17 and 18 illustrate a state where the seat 1 is moved in a front-rear direction, and FIG. 22 illustrates a state where the seat 1 is moved in a left-right direction.

In the seat 1, a circumference of a seat main body 11 is covered with upholstery 12, and the seat 1 is attached to the movement mechanism 3 via a seat shell 13. The seat shell 13 includes an inner seat shell 131 attached to a bottom surface of the seat main body 11 and an outer seat shell 132 that, backs up the inner seat shell 131 and secures the connection to the movement mechanism 3.

Figure 6:
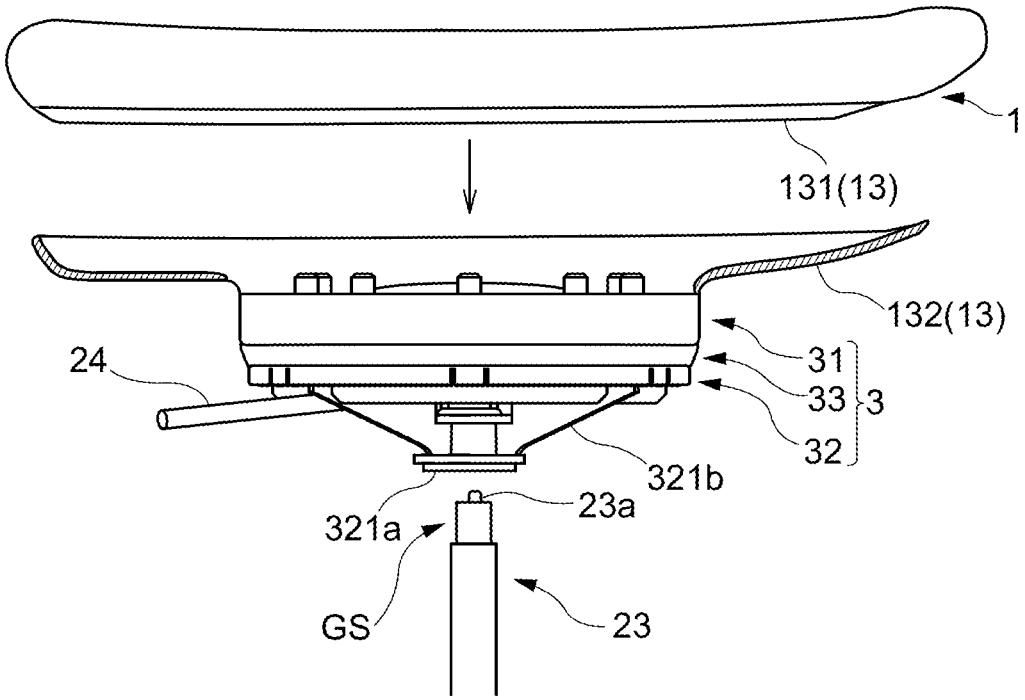
FIG. 6 is a diagram illustrating a relationship between a movement mechanism, the seat, and a leg constituting the chair

The leg 2 includes casters 22 at a lower end of a leg vane 21, and a leg support post 23 erected from a center portion of the leg vane 21, and the seat 1 is rotatable attached to an upper end side of the leg support post 23. The leg support post 23 can be extended and contracted by a gas spring mechanism GS illustrated in FIG. 6 incorporated therein. In FIG. 6, a reference numeral 24 indicates an operation lever for operating an operated unit 23*a* of the gas spring mechanism GS.

As illustrated in FIGS. 6 to 11, in the movement mechanism 3, an upper base unit. 31 and a lower base unit 32 are arranged to face each other, the lower base unit 32 is attached to the leg support post 23, and the seat 1 is attached to the upper base unit 31. An elastic member 33 is interposed between the upper base unit 31 and the lower base unit 32. The periphery of the elastic member 33 is covered with a cover member 6, as illustrated in FIGS. 19, 20, 23, and FIGS. 25A to 25C, but the cover member 6 is omitted in the other drawings. Further, in FIGS. 10, 13, and the like, the elastic member 33 is omitted.

Figure 19:
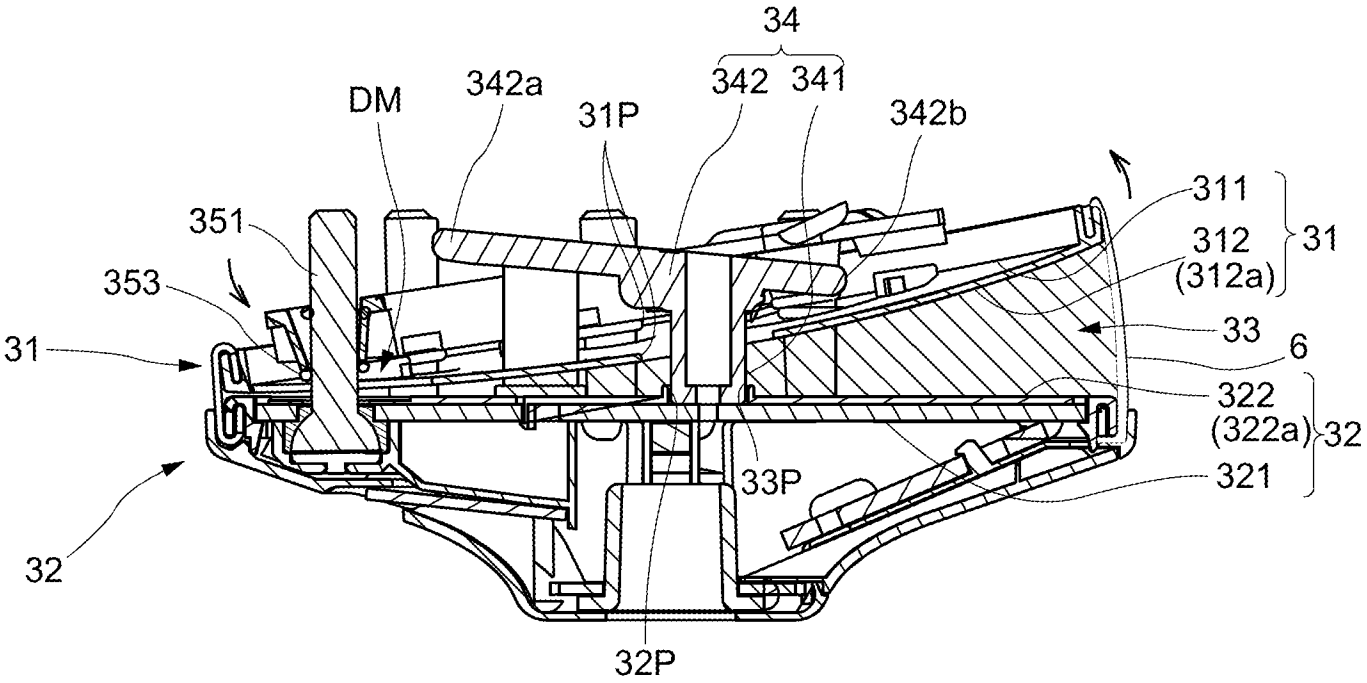
FIG. 19 is a cross-sectional view corresponding to FIG. 16 when the seat is tilted forward.
Figure 20:
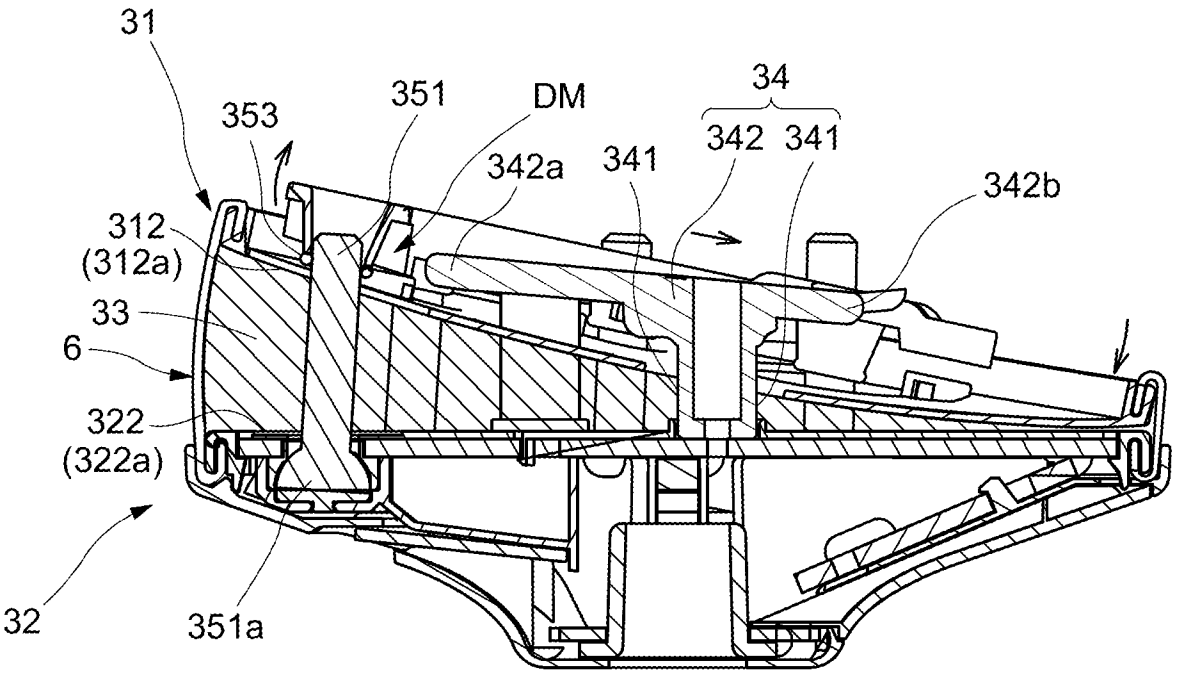
FIG. 20 is a cross-sectional view corresponding to FIG. 16 when the seat is tilted rearward.
Figure 21:
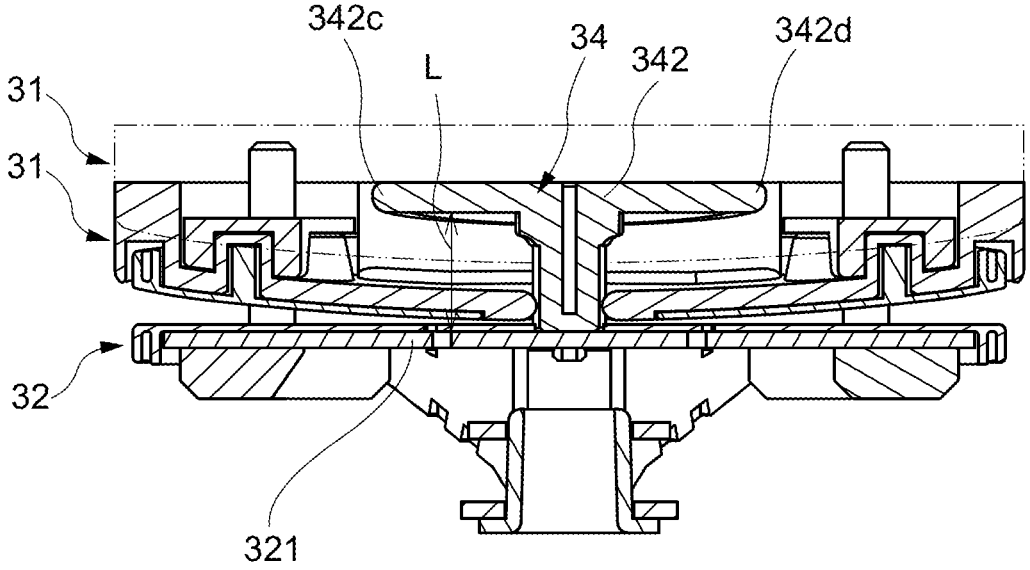
FIG. 21 is a cross-sectional view taken along line XXI-XXI in FIG. 7.
Figure 23:
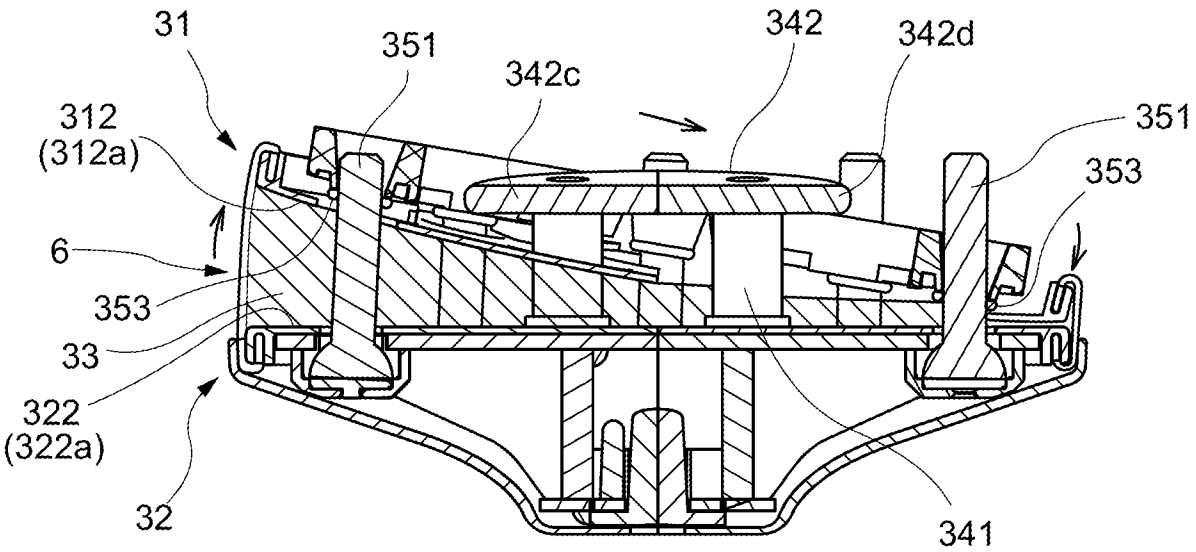
FIG. 23 is a cross-sectional view corresponding to FIG. 21 when the seat is tilted to the left and right.

The movement mechanism 3 supports the upper base unit 31 movably with respect to the lower base unit 32. In the front-rear direction as illustrated in FIGS. 19 to 21 and in the left-right direction as illustrated in FIGS. 21 and 23, and further in directions of 360 degrees including these directions.

Figure 9:
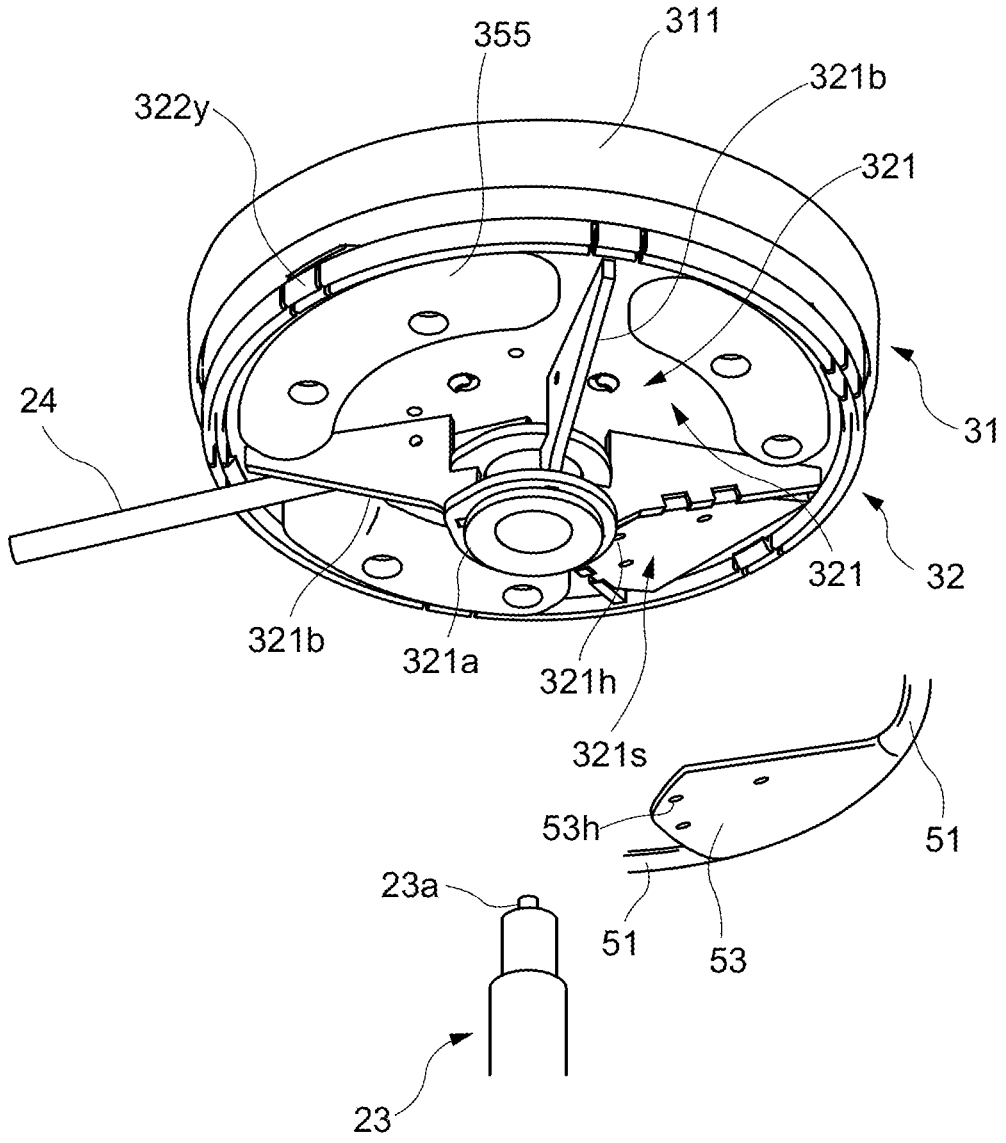
FIG. 9 is a bottom perspective view of the movement mechanism.
Figure 10:
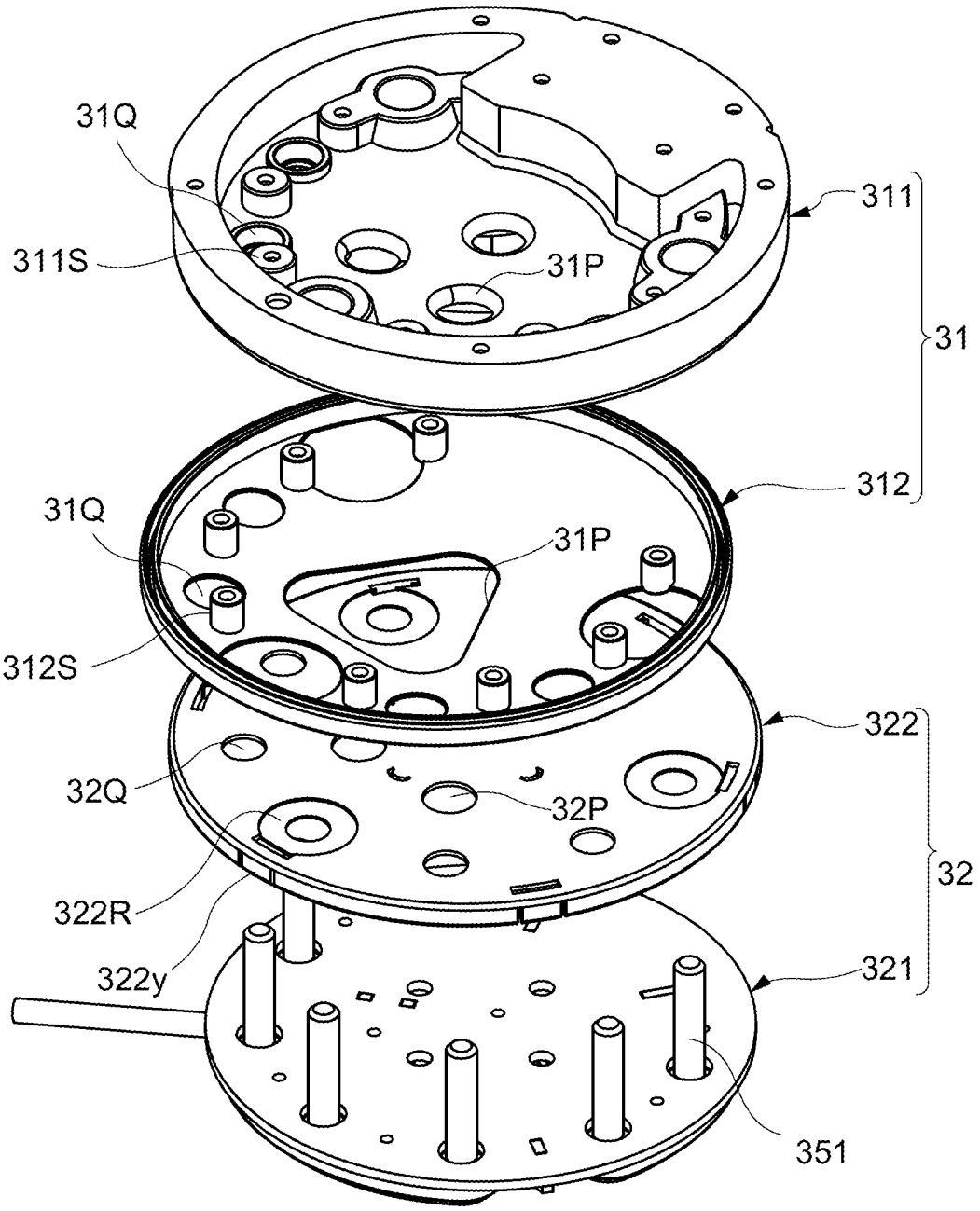
FIG. 10 is an exploded perspective view of the movement mechanism.

As illustrated in. FIG. 10, the upper base unit. 31 includes a disk-shaped seat receiver 311 and a disk-shaped upper base plate 312 attached under the seat receiver 311. The seat receiver 311 illustrated in FIGS. 7 to 10, and the like is illustrated as a single body but the seat receiver 311 is actually integrally formed of a resin together with the outer seat shell 132 in the periphery thereof, as illustrated in FIG. 5 and the like. The upper base plate 312 is provided with high nuts 312*s*, and the seat receiver 311 is provided with boss holes 311*s* at positions corresponding to the high nuts 312*s*. In a state where a bottom surface of the seat receiver 311 abuts against a top surface of the high nuts 312*s*, the upper base plate 312 and the seat receiver 311 are coupled by bolts (not illustrated) inserted through the seat receiver 311 and the high nuts 312*s* from above.

As illustrated in. FIG. 10, the lower base unit 32 includes a disk-shaped support base unit 321 attached to the upper end of the leg support post 23 and a disk-shaped lower base plate 322 attached on the support base unit 321. In FIG. 10, reference numeral 322*y* indicates an engaging claw provided in the lower base plate 322, and the engaging claw 322*y* engages with a peripheral edge portion of the support base unit 321 so that the lower base plate 322 and the support base unit 321 are integrated. As illustrated in FIGS. 6 and 9, a leg mounting unit 321*a* into which the leg support post 23 is fitted is provided in a bottom surface of the support base unit 321, and the leg mounting unit 321*a* is reinforced by ribs 321*b* extending in a radial direction to increase the rigidity of the leg mounting unit 321*a*. The operated unit 23*a* used to operate a gas spring is provided at the upper end of the leg support post 23 and in a state where the leg support post 23 is inserted into the leg mounting unit 321*a*, the operated unit 23*a* is arranged at a position where the operated unit 23*a* can be operated by an operation unit 24.

Figure 13:
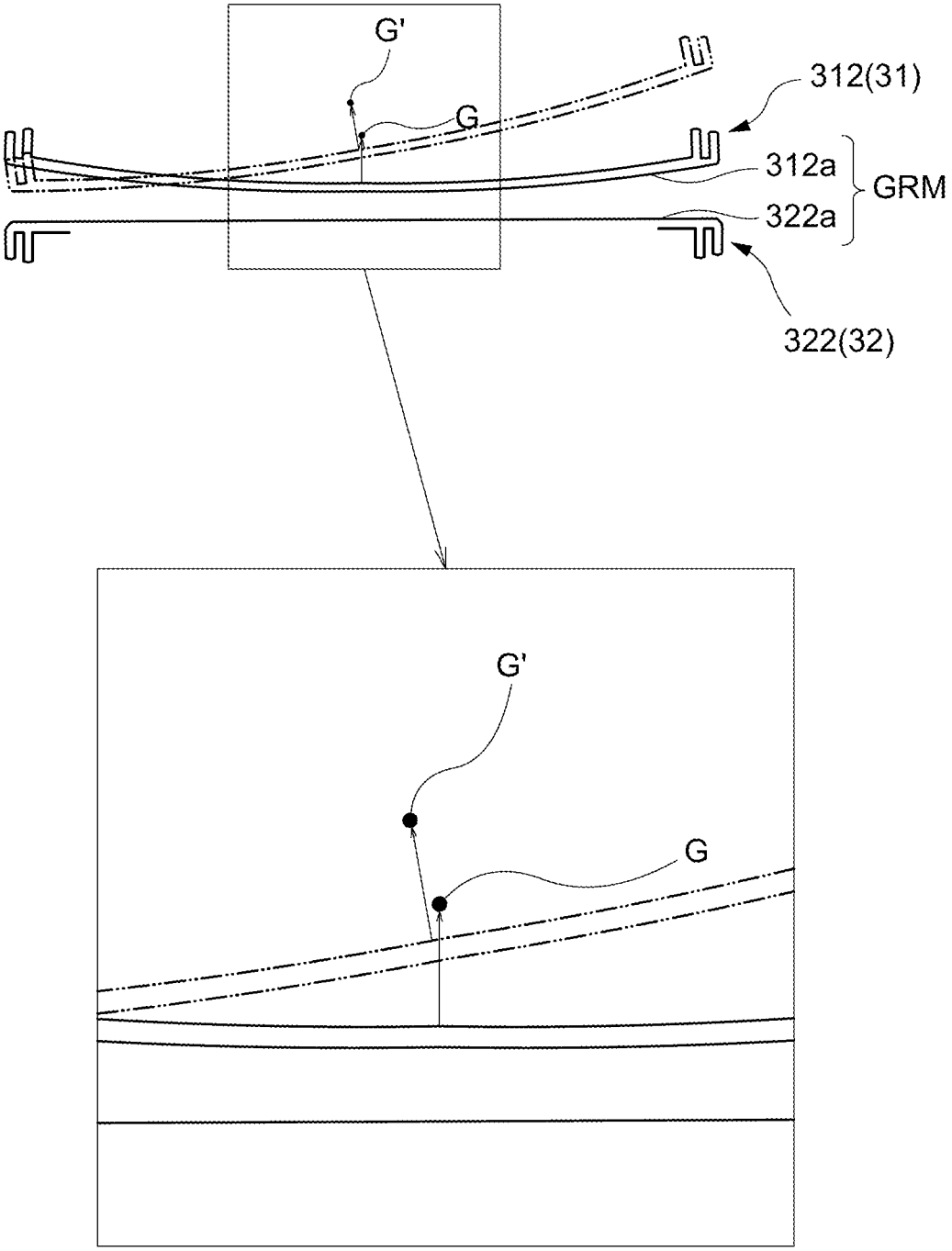
FIG. 13 is a diagram for describing rolling surfaces facing each other constituting the movement mechanism.

FIG. 13 is a schematic view of rolling surfaces constituting the movement mechanism 3, in which the elastic member 33 is omitted. As illustrated in FIG. 13, surfaces of the upper base unit 31 and the lower base unit 32 that face each other (in the present embodiment, a facing surface 312*a* of the upper base plate 312 constituting the upper base unit 31 and a facing surface 322*a* of the lower base plate 322 constituting the lower base unit 32) form rolling surfaces that roll with respect to each other. In the present embodiment, the rolling surface 322*a* of the lower base plate 322 is composed of a flat surface, the rolling surface 312*a* of the upper base plate 312 is composed of a curved surface that bulges toward the rolling surface 322*a* of the lower base plate 322, and a contact section between the upper base unit 31 and the lower base unit 32 changes according to a rolling operation, as illustrated by an imaginary line in FIG. 13. Needlessly to say, the lower base plate 322 may be a curved surface, the upper base plate 312 may be a flat surface, and both the upper base plate 312 and the lower base plate 322 may be curved surfaces.

The curved surface has a substantially partial spherical shape or a substantially arc-shaped cross section, in other words, the curved surface has a bowl-shape or a convex R-shape, and the upper base unit 31 may move in directions of 360 degrees including the front-rear, left-right, and diagonal directions, while rolling on the lower base unit 32. The curved surface may be implemented in various modes, such as a surface that is curved at a constant curvature, even at a position separated from a reference position N which is a contact position between the two base units 31 and 32 when no load is applied, a surface having a curvature that smoothly changes as the distance from the reference position N increases, a surface having different curvature in the front-rear and left-right directions, and a surface having different curvature between the front and the rear.

Figure 11:
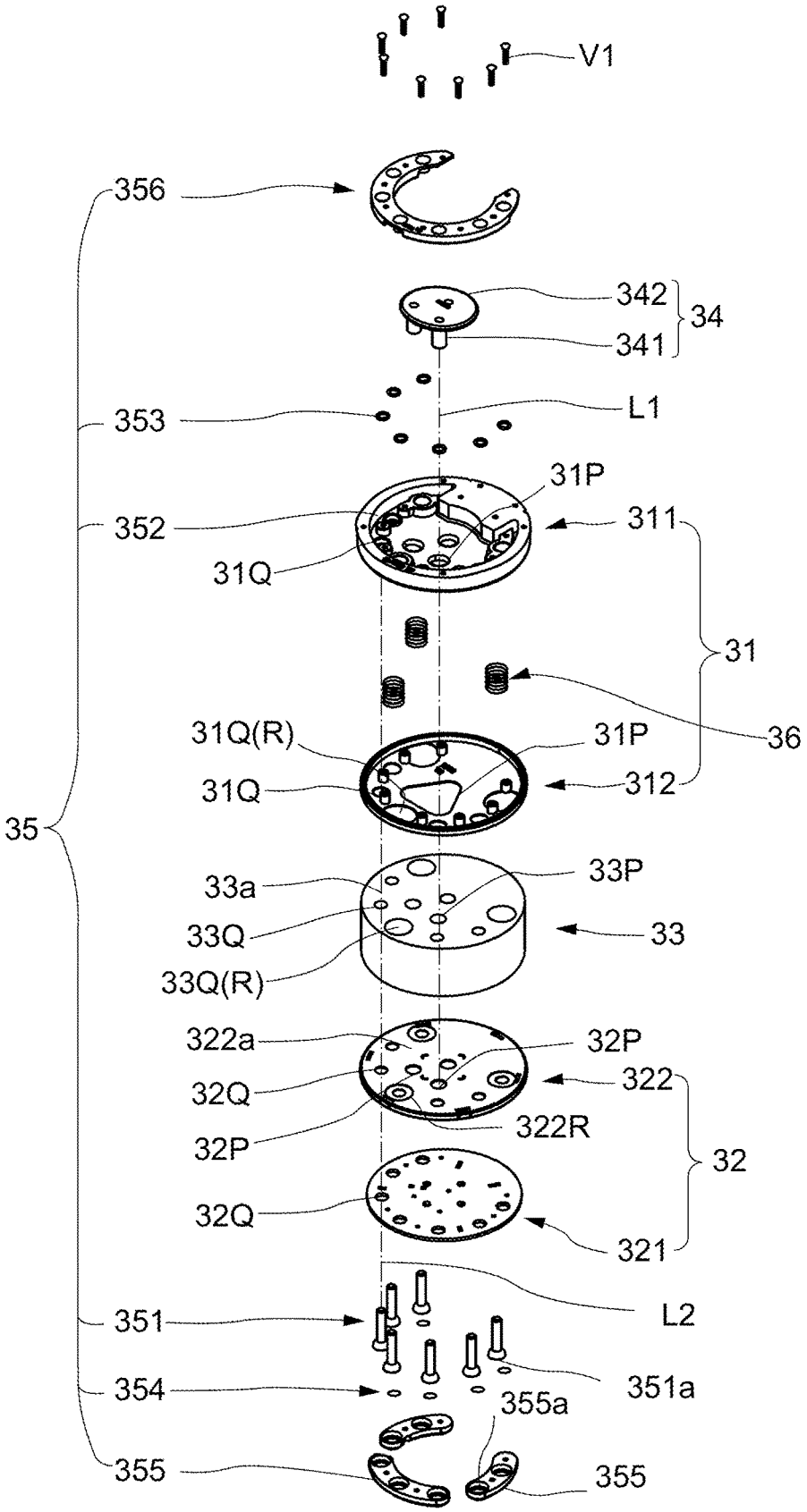
FIG. 11 is a top perspective view obtained by further disassembling components in FIG. 10.
Figure 12:
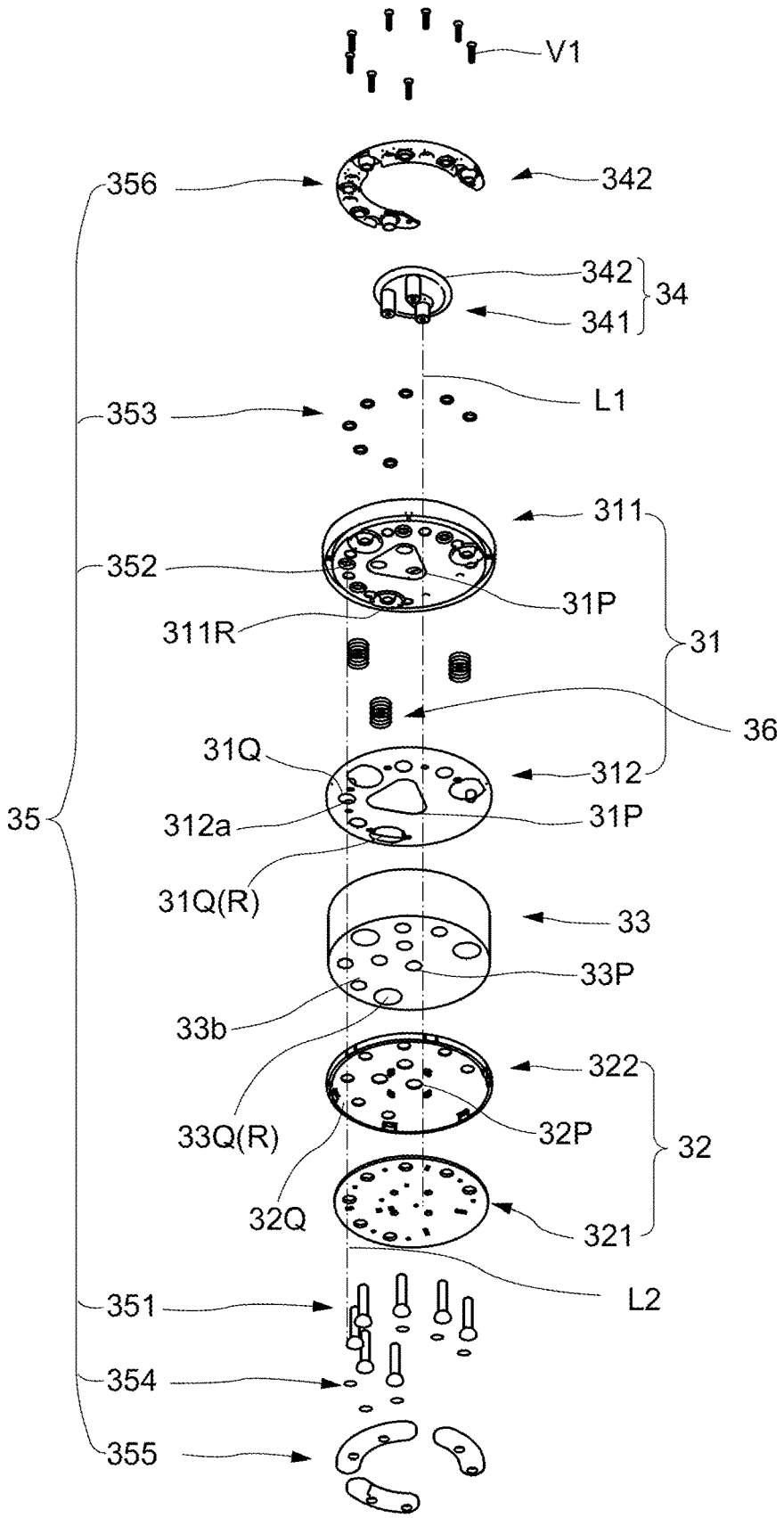
FIG. 12 is a bottom perspective view obtained by further disassembling components in FIG. 10.

As illustrated in FIGS. 10 to 12, the upper base plate 312 and the lower base plate 322 constitute surfaces (rolling surfaces) 312*a* and 322*a* facing each other and moving relative to each other. The upper base plate 312 and the lower base plate 322 also serve as mounting members for mounting the cover member 6 for hiding a gap between the rolling surfaces 312*a* and 322*a*, as described later with reference to FIGS. 25A to 25C. On the other hand, for example, in FIGS. 10 to 12, in a case where the upper base Plate 312 and the lower base plate 322 are provided at positions that do not form surfaces facing each other, or in a case where the cover member (3 is attached to a position where a part of the movement mechanism 3 is concealed in another mode and the like, the bottom surface of the seat receiver 311 and a top surface of the support base unit 321 may form surfaces (rolling surfaces) facing each other. In this case, the upper base plate 312 and the lower base plate 322 are not necessarily required.

As illustrated in. FIGS. 11 and 12, the elastic member 33 is attached to the rolling surfaces 312*a* and 322*a* in a state where a top surface 33*a* and a bottom surface 33*b* contact the rolling surfaces 312*a* and 322*a*, respectively, and the elastic member 33 is formed of an elastic resin foam body to form a columnar shape when no load is applied. High-elastic urethane foam, low-elastic urethane foam, and the like may be adopted as the elastic resin foam body. High-elastic urethane foam instantly deforms upon receiving an external force, and thus exerts a buffering effect. Low-elastic urethane foam gradually deforms upon receiving an external force, and thus exerts a delay effect.

In the present embodiment, the high-elastic urethane foam is adopted, because high-elastic urethane foam has low temperature dependence and excellent durability. Needlessly to say, low-elastic urethane foam may be used for the elastic member, or a thin member such as an elastic sheet may be used.

When the upper base unit 31 receives a load and moves in any direction of 360 degrees including the front-rear, left-right, and diagonal directions with respect to the lower base unit 32, as illustrated in FIGS. 19, 20, 23, and the like, the rolling surface 312*a* of the upper base plate 312 moves while compressing the elastic member 33 between the rolling surface 312*a* and the rolling surface 322*a* of the lower base plate 322, and with this movement, the upper base plate 312 tilts downward in a movement direction. A swing operation in which the seat 1 tilts downward in the movement direction according to such a movement of a seated person is realized via the upper base unit 31.

Generally, it is conceivable to use, as the movement mechanism, a guide mechanism composed of a cam and a follower between an upper base unit and a lower base unit, and a link mechanism connecting the upper base unit and the lower base unit. Compared to such a structure, the movement mechanism 3 of the present embodiment utilizes the rolling surfaces 312*a* and 322*a* to realize an operation of the seat 1 in which a tilting movement component is larger than a horizontal movement component. The chair of the present embodiment that performs such an operation is particularly easy to use in a situation where a person frequently sits down and stands up from a seat.

The curvatures of the rolling surfaces 312*a* and 322*a* are set so that a gravity center position G of the seat 1 is lifted to G' by the movement, as illustrated by a solid line and an imaginary line in FIG. 13, and the rolling surfaces 312*a* and 322*a* constitute a gravity return mechanism GEM that generates, according to a body weight, a return force for returning the seat 1 to the reference position N, which is a position when no load is applied.

As illustrated in FIGS. 11 and 12 the movement, mechanism 3 is provided with a first connection member 34 that fixes the upper base unit 31 to the lower base unit 32 so that the upper base unit 31 does not separate from the lower base unit 32, and regulates a relative rotation, and a second connection member 35 for imparting a damper function to the movement mechanism 3. The damper function is imparted to suppress an abrupt movement of the seat 1, considering that the movement, mechanism 3 of the present embodiment performs a rolling operation and high-elastic urethane foam that deforms quickly is adopted as the elastic member 33.

In addition, in the upper base unit 3L the lower base unit 32, and the elastic member 33, first holes 31P to 33P for inserting a pin 341 constituting the first connection member 34 are opened along a first line L1, and second holes 31Q to 33Q for inserting a shaft 351 constituting the second connection member 35 are opened along a second line L2. The holes 31P, 32P, 33P, 31Q, 32Q, and 33Q prevent the pin 341 and the shaft 351 from interfering with the rolling surfaces 312*a* and 322*a* and the elastic member 33, and thus, are also referred to as "relief holes" herein.

The first connection member 34 is mainly composed of three of the pins 341, and the pins 341 are formed as an integral member with a flange unit 342. The pins 341 are inserted through the first hole 31P of the upper base unit 31 (that is, the first hole 31P of the seat receiver 311 and the first hole 31P of the upper base plate 312), the first hole 33P of the elastic member 33, and the first hole 32P of the lower base unit 32 (that is, the first hole 32P of the lower base plate 322), respectively, and the pins 341 are fastened from below by bolts (not illustrated) at positions where the pins 341 abut against the support base unit 321 constituting the lower base unit 32. FIG. 19 and the like illustrate the state described above. The first holes 31P of the seat receiver 311 are opened at three locations corresponding to the positions of the three pins 341, whereas the first hole 31P of the upper base plate 312 is a large opening for receiving all the three pins 341.

Figure 16:
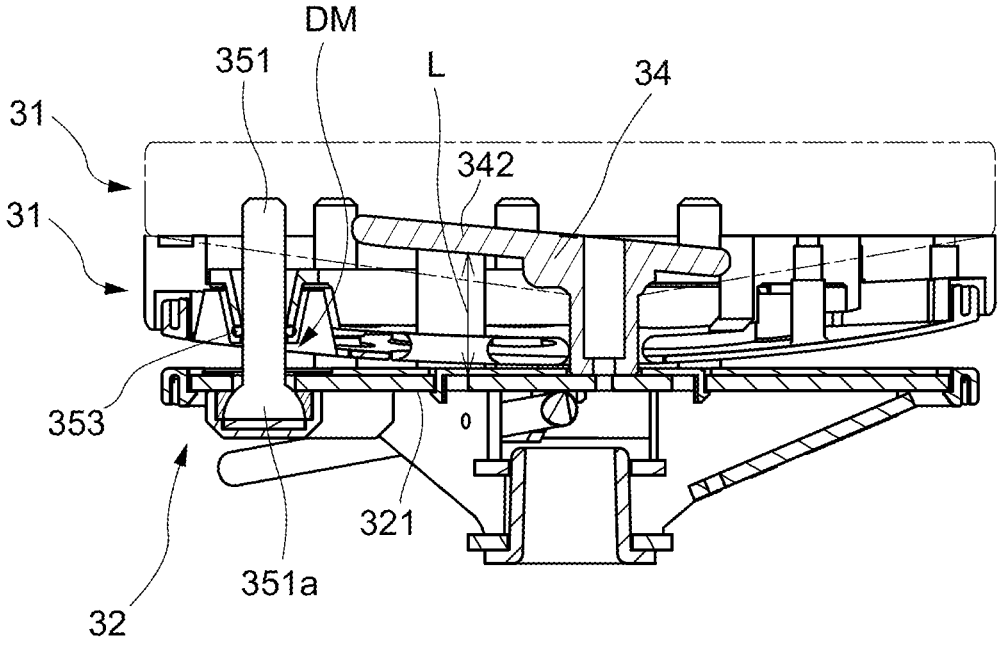
FIG. 16 is a cross-sectional view taken along line XVI-XVI in FIG. 7.

With such a structure, for example, a relative position (distance L) between the flange unit. 342 of the first connection member 34 and the support base unit 321 in FIGS. 16 and 21 is fixed. In FIGS. 16 and 2L the elastic member 33 is omitted, and the upper base unit. 31 descends almost to the maximum extent as illustrated by a solid line and approaches the lower base unit 32. However, if the elastic member 33 is interposed and a small load is applied, the upper base unit 31 rises to a position indicated by the imaginary line in FIGS. 16 and 21.

When the seat 1 swings in the front-rear direction as illustrated in FIGS. 19 and 20, or in the left-right direction as illustrated in FIG. 23, the upper base unit 31 is movable between the flange unit 342 constituting the first connection member 34 and the support base unit 321 (specifically, in a range of the distance L between the flange unit 342 and the lower base plate 322). The upper base unit 31 moves while compressing the elastic member 33, and thus, when the applied load is released, the upper base unit 31 rises by a return force of the elastic member 33 as illustrated in. FIGS. 16 and 21, and as indicated by the imaginary line, the upper base unit 31 is prevented from rising further at a position where a part of the upper base unit. 31 abuts against the flange unit 342. The flange unit 342 prevents the upper base unit 31 from being detached upward, and also restricts a tilt angle when the upper base unit 31 is tilted to the front, rear, left, right, or diagonally.

In the present embodiment, as illustrated in FIGS. 16, 19, and 20, the flange unit 342 is provided inclined in the front-rear direction, so that a front end 342*a* is higher than a rear end 342*b*. That is, as illustrated in FIG. 19, when the upper base unit 31 tilts forward, the rear end 342*b* of the flange unit 342 restricts a forward tilt angle of the upper base unit 31, whereas as illustrated in FIG. 20, when the upper base unit 31 tilts rearward, the front end 342*a* of the flange unit 342 restricts a rearward tilt angle of the upper base unit. 31, and a larger rearward tilt angle than the forward tilt angle is permitted. As illustrated in FIGS. 21 and 23, a left end 342*c* and a right end 342*d* of the flange unit 342 are at the same height position at the left and right, so that inclination of the upper base unit 31 is possible to the left direction and the right direction at the same angle.

As illustrated in FIGS. 11, 20, and the like, the three pins 341 are each fixed to the support base unit 321, and the pins 341 are inserted through the upper base plate 312 and the seat receiver 311. Therefore, the upper base unit 31 which is a combination of the upper base plate 312 and the seat receiver 311, is prevented from rotating with respect to the lower base unit 32 which is a combination of the support base unit 321 and the lower base plate 322, and the elastic member 33 through which the pins 341 are inserted is also prevented from twisting clockwise or counterclockwise in a plan view. Needlessly to say, the number of pins is not limited to three.

Figure 14:
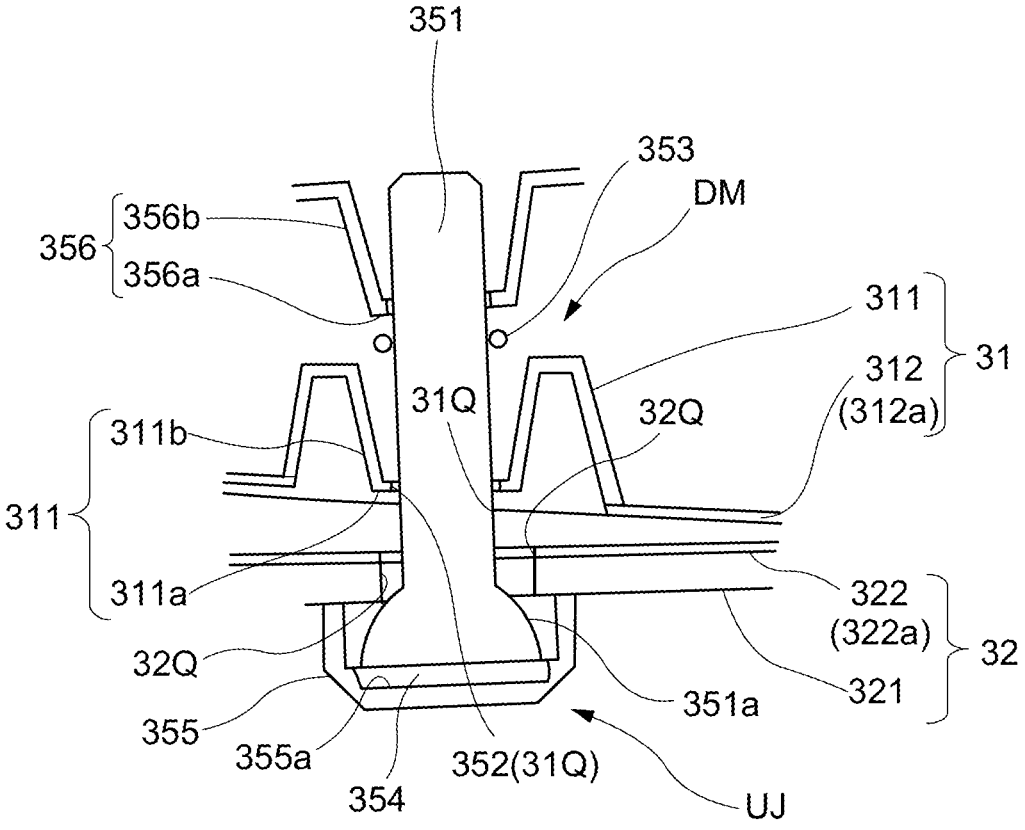
FIG. 14 is a diagram illustrating a built-in structure of a damper mechanism provided together with the movement: mechanism.

As described above, the second connection member 35 imparts a damper effect to the operation of the movement mechanism 3. Specifically, as illustrated in FIG. 14 and the like, the second connection member 35 is mainly composed of seven of the shafts 351 which are columnar members, and a damper mechanism DM, which is a braking mechanism, is formed by hole units 311*b* into which the shafts 351 are inserted and O-rings 353 made of a friction material that are arranged between the shafts 351 and the hole units 311*b*. In the present embodiment, the hole units 311*b* correspond to recessed units of ribs provided by forming projections and recesses at a bottom wall of the seat receiver 311 constituting the upper base unit 31, and shaft holes 352 through which the shafts 351 pass are opened at hole bottoms of the hole units 311*b*. Seven sets of the shafts 351 the hole units 311*b*, and the O-rings 353 are provided. Needlessly to say, the number of sets is not limited thereto.

Each of the shafts 351 is a bolt-shaped shaft having a large-diameter proximal end unit 351*a* at a lower end. In a state where the upper end side of the shafts 351 is inserted through the second hole 32Q of the support base unit 321 from the bottom surface side of the support base unit 321, the proximal end unit 351*a* is accommodated in a recessed unit 355*a* of a cocoon-shaped (see FIGS. 11, 12, and the like) abutting plate 355 via an elastic plate 354. In this state, the abutting plate 355 abuts against the bottom surface of the support base unit 321 and is fixed with screws (not illustrated), so that the shafts 351 are attached in a state of protruding upward from the support base unit 321, as illustrated in FIG. 10.

As illustrated in. FIGS. 14, 19, 20, and the like, the proximal end unit 351*a* has a spherical or flat spherical shape, and combined with the elastic deformation of the elastic plate 354 interposed between the proximal end unit 351*a* and the abutting plate 355, the shaft 351 is connected to the support base unit 321 of the lower base unit 32 to be swingable around the proximal end unit 351*a*. That is, the proximal end unit 351*a* of the shaft 351, the elastic plate 354, and the recessed unit 355*a* of the abutting plate 355 form a non-directional joint UJ (see FIG. 14). Needlessly to say, another configuration such, as a ball joint may be employed as a non-directional joint in which the shaft 351 is swingable around the proximal end.

The shafts 351 protrude upward via the second hole 32Q of the lower base unit 32 (that is, the second hole 32Q of the support base unit 321 and the second hole 32Q of the lower base plate 322), the second hole 33Q of the elastic member 33 (not illustrated in FIG. 14), and the second hole 31Q of the upper base unit 31 (that is, the second hole 31Q of the upper base plate 312 and the second hole (shaft hole) 31Q of the seat receiver 311). The shafts 351 constitute the damper mechanism DM.

Figure 15:
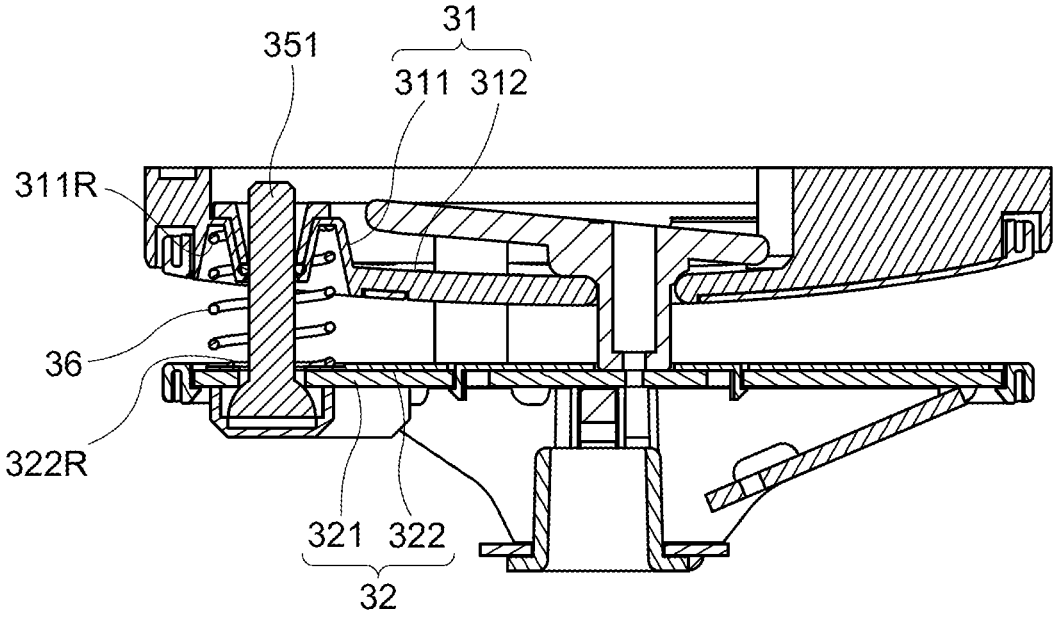
FIG. 15 is a diagram illustrating a built-in structure of a return spring provided together with the movement mechanism.

On the other hand, as illustrated in FIGS. 11, 12, 15, and the like, a return spring 36 serving as a third connection member is interposed around an outer periphery of the shaft 351 to be interposed between the upper base unit 31 and the lower base unit 32 and connect: the upper base unit 31 and the lower base unit 32. In the present embodiment, the return spring 36 is a coil spring. In three of the seven second holes 31Q to 33Q described above, a recessed retainer unit 322R that supports a lower end of the return spring 36 in a positioned state is formed on the lower base plate 322 of the lower base unit 32, and the second holes 33Q (R) and 31Q (R) opened at three locations of the elastic member 33 and the upper base plate 312 have a larger diameter than the return spring 36. A recessed retainer unit 311R that accommodates an upper end of the return spring 36 in a positioned state is formed in three corresponding locations among the seven locations where the second holes 31Q are provided in the bottom surface of the seat:

receiver 311 constituting the upper base unit 31.

The return spring 36 is arranged at a plurality of locations (three locations in the present embodiment) over a range of 180 degrees or more (for example, 270 degrees) around a center position (reference numeral O in FIG. 7) of the movement mechanism 3. Therefore, if the upper base unit 31 is tilted in any direction including the front-rear, left-right, and diagonal directions, the return spring 3$ on the tilted side is compressed, and the return spring 36 assists the return force for returning the upper base unit 31 to the reference position N when no load is applied. The back 4 is integrally attached to the seat 1, and thus, the return spring 36 also supports a load of a movable portion including the seat 1 and the back 4. A structure in which the return spring 36 on the side opposite to the tilted side is pulled may be adopted as the configuration of the return spring 36.

As described above, the second connection member 35 has a configuration in which the O-rings 353 made of a friction material are fitted between the shafts 351 which are columnar members, and the hole units 311*h*.

Specifically, as illustrated in FIG. 14, the shaft holes 352 open in a bottom wall 311*a* of the seat receiver 311 constituting the upper base unit 31, and the periphery of the bottom wall 311*a* constitutes the hole units 311*b* that have a tapered shape and open upward.

On the other hand, as illustrated in FIGS. 8, 11, 12, 14, and the like, a pressing tool 356 has a C-shape in a plan view. The pressing tool 356 includes an end unit 356*a* facing the bottom wall 311*a*, and a periphery of the end unit 356*a* constitutes a projecting unit 356*b* that has a tapered shape and protrudes downward.

An inner diameter of the O-rings 353 is chosen so that the O-rings 353 fit with the shafts 351 with a predetermined sliding resistance, and the predetermined sliding resistance is chosen so that a required damper effect can be obtained when the seat 1 swings. In the present embodiment, NBR rubber is used for the O-rings 353. However the material is not limited thereto, and various materials may be adopted as the material for realizing the sliding resistance.

Figure 7:
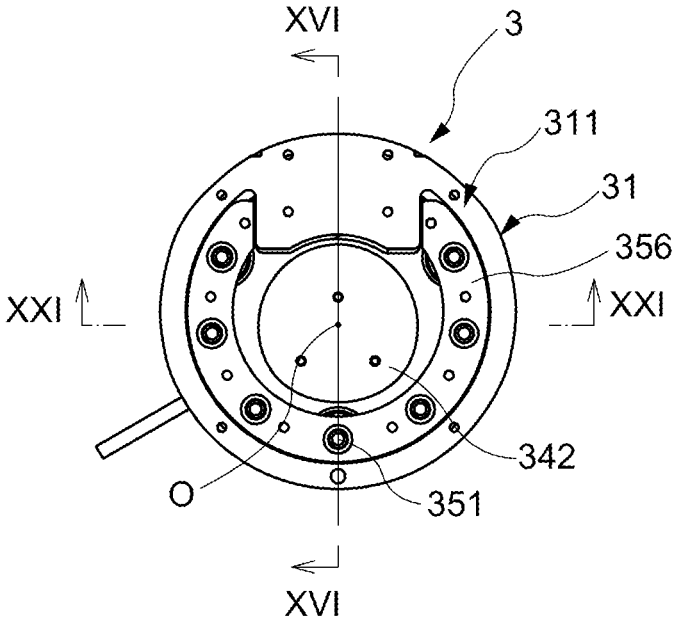
FIG. 7 is a plan view of the movement mechanism.
Figure 8:
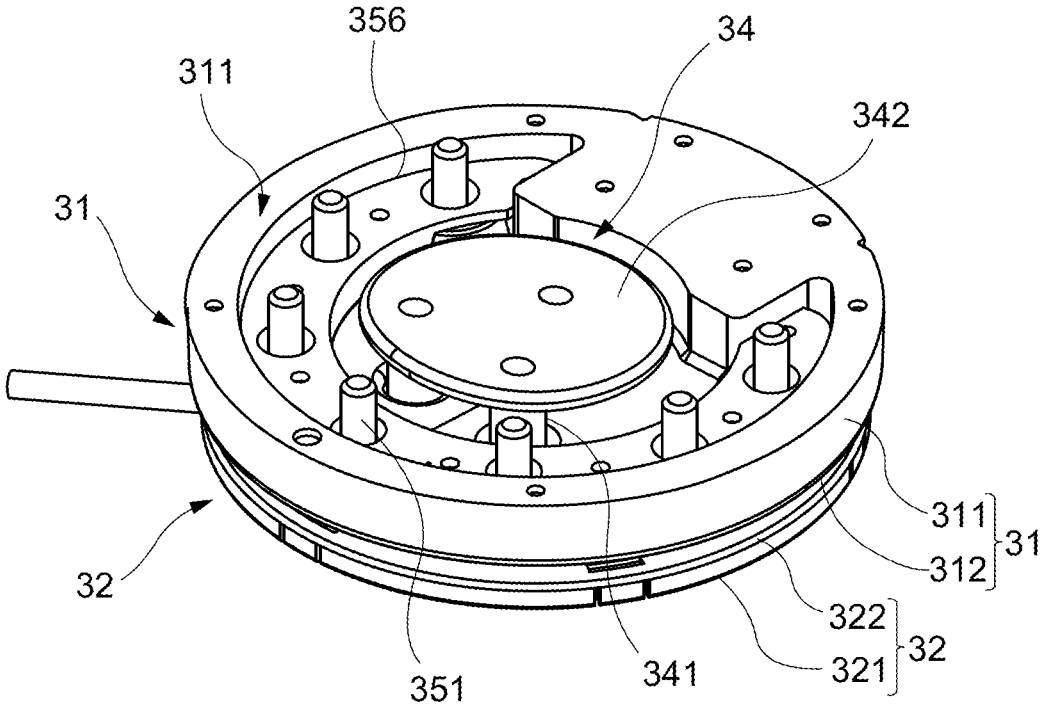
FIG. 8 is a top perspective view of the movement mechanism.

The shafts 351 are passed through the shaft holes 352 and fitted to the O-rings 353 from above, and the pressing tool 356 is pushed from above to fit the projecting unit 356*b* into the hole unit 311*b*. Thus, the O-rings 353 are pressed against the bottom wall 311*a* of the seat receiver 311 by the end unit 356*a* to realize the assembled state illustrated in FIGS. 16, 20, and the like. In this state, the pressing tool 356 is fastened to a top surface of the seat receiver 311 by bolts V1 illustrated in FIGS. 11, 12, and the like, so that: the O-rings 353 are fixed to the seat receiver 311 and therefore the upper base unit 31, as illustrated in. FIG. 7. At this time, the O-ring 353 illustrated in FIG. 14 is deformed into a flat elliptical shape, and abuts against: the outer periphery of the shaft. 351 not at a point, but at a surface having an area of a certain size or more.

If the upper base unit 31 swings, as illustrated in FIGS. 19, 20, and the like, the O-rings 353, which are friction members fitted to the shafts 351 white being attached to the seat receiver 311 of the upper base unit. 31, change a fitting position with respect: to the shafts 351, which are columnar members in which the proximal end unit 351*a* is swingably attached to the lower base unit 32, while sliding along the shafts 351 together with the hole units 311*b*. The shafts 351 swing in response to the swinging of the O-rings 353 and follow the change in angle of the upper base unit 31 with respect to the lower base unit 32. At this time, a relative movement of the hole units 311*b* and the O-rings 353, which are friction members, with respect to the shafts 351, which are columnar members constituting the damper mechanism DM, is a sliding motion along a longitudinal direction of the shafts 351. The shafts 351 may be formed of a bendable and flexible material. In this case, the hole units 311*b* and the O-rings 353 can move along the longitudinal direction of the shafts 351, without swingably supporting the shafts 351.

That is, the damper mechanism DM is arranged at a Plurality of locations around a center position of the upper base unit 31 over a range of 180 degrees or more (for example, 270 degrees). Therefore, if the seat 1 moves in any direction of 360 degrees, the shafts 351 and the O-rings 353 operate while following the movement: of the seat 1 and sliding relative to each other, and exert a damper action by a sliding resistance in both directions of an operation in which a distance between the upper base unit 31 and the lower base unit 32 is expanded or contracted.

In a chair having such a configuration, in a state where no seating load is applied, the gravity return mechanism GRM mentioned above attempts to return the chair to a position (reference position) where the center of gravity of the movable portion including the upper base unit 31, the seat 1, and the back 4 is lowest. At that time, a restoring force of the elastic member 33 and an auxiliary restoring force of the return spring 30 act together, and thus, the chair stops at the overall most stable position. FIGS. 1 to 3 illustrate a state where the seat 1 is in the reference position N.

The seat 1 of the chair can swing from the reference position N in any direction of 360 degrees including the front-rear, left-right, and diagonal directions, when the upper base plate 312 performs a rolling operation with respect to the lower base Plate 322.

Figure 24:
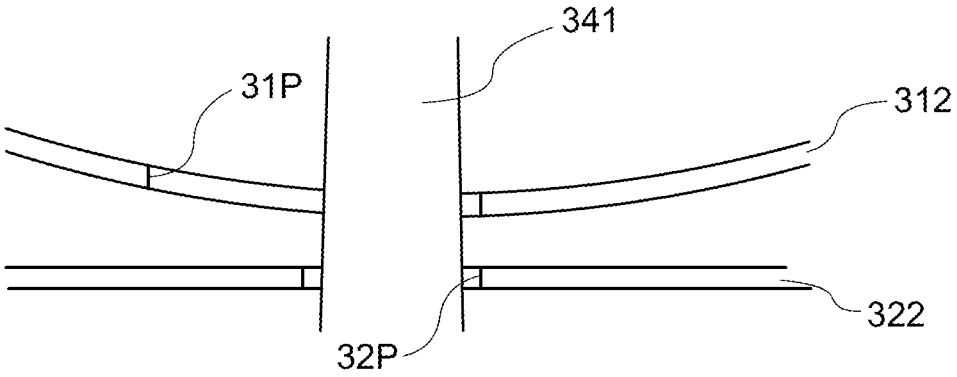
FIG. 24 is a diagram illustrating a built-in structure of a pin provided together with the movement mechanism.

In the rolling surfaces performing such a rolling operation, the upper base plate 312 and the lower base plate 322, which are surfaces facing each other, include the first holes 31P and 32P for passing the pins 341 constituting the first connection member as illustrated in FIG. 24 the second holes 31Q and 32Q for passing the shafts 351 constituting the second connection member as illustrated in FIG. 14, the recessed retainer unit 322R (see FIGS. 11 and 12) for accommodating the return spring 36 which is the third connection member, a return spring insertion hole in the upper base Plate 312, and the like. In particular, the first hole 31P in the upper base plate 312 illustrated in FIG. 24 is a hole having a large opening to avoid interference with the three pins 341, and the second holes 31Q and 32Q illustrated in FIG. 14 are provided for each of the shafts 351, so that the number of the second holes 31Q and 32Q is large. As illustrated in FIGS. 11, 12, and the like, three of the second holes 31Q and 32Q have a large diameter so that the return spring 36 can also pass through.

In the holes 31P, 32P, 31Q, 32Q, and the like, regions having different so-called curvatures are formed and the continuity of the rolling surfaces 312*a* and 322*a* is impaired. Therefore, if the upper base plate 312 constituting the upper base unit 31 rolls directly on the lower base plate 322 constituting the lower base unit 32, the upper base unit 31 is likely to rattle due to the change in the curvature. The rattling propagates as a rattling of the seat 1.

On the other hand, in the present embodiment, the elastic member 33 is interposed between the above-described region in one of the upper base unit 31 and the lower base unit 32 and a corresponding region in the other one of the upper base unit 31 and the lower base unit 32. The elastic member 33 lowers the stability when opening peripheral edges of the holes 31P, 31Q, and the like existing in the rolling surface 312*a* of the upper base unit 31 abut against the rolling surface 322*a* of the lower base unit 32 facing the rolling surface 312*a*, and lowers the stability when opening peripheral edges of the holes 32P and 32Q existing in the rolling surface 322*a* of the lower base unit 32 abut against the rolling surface 312*a* of the upper base unit 31 facing the rolling surface 322*a*. That is, the elastic member 33 facilitates rolling between the rolling surfaces 312*a* and 322*a* at a place where the curvature of the rolling surfaces 312*a* and 322*a* changes and smooths the change of the curvature. Needlessly to say, even in a place where no hole is formed, and also a place where the surface of the rolling surfaces 312*a* and 322*a* is irregular or deteriorated, the elastic member has an effect of reducing the rattling caused by the irregular or deteriorated surface.

As illustrated in FIGS. 20, 23, and the like, the distance between the upper base unit 31 and the lower base unit 32, which are rolling surfaces facing each other, is smaller on the side to which the upper base unit 31 is tilted and larger on the opposite side. The elastic member 33 is interposed between the upper base unit. 31 and the lower base unit 32, and thus, the elastic member 33 is elastically restored on the larger side and the elastic member 33 is compressed on the smaller side, until a thickness of the elastic member 33 is very small. The elastic member 33 accommodates the pins 341 that form the main body of the first connection member 34 and the shafts 351 that form the second connection member 35 in the first holes 33P and the second holes 33Q, and thus the elastic member 33 conceals the pins 341 and shafts 351 as viewed sideways. However, the elastic member 33 does not hide a gap between the upper base unit 31 and the lower base unit 32, and thus, does not include a function of preventing foreign bodies from entering the gap. Unlike between the rolling surfaces 312*a* and 322*a*, there is no direct or indirect contact, however, it is also necessary to hide a region between a pair of swinging surfaces including surfaces facing each other; and thus the circumstance is common.

Figure 25A:
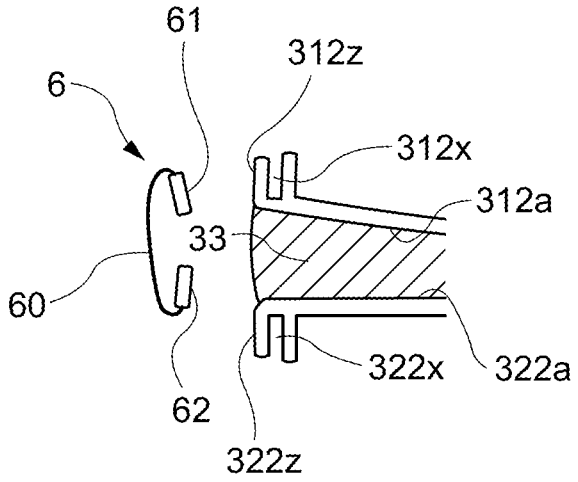
FIGS. 25A to 25C are diagrams illustrating a mounting structure of a cover member.

Therefore, in the present embodiment, as illustrated in FIGS. 20, 25A, and the like, the elastic member 33 is arranged at a portion extending from the vicinity of outer peripheral edges 312*z* and 322*z* of both swinging surfaces 312*a* and 322*a* facing each other to the inside thereof, and a stretchable sheet material 60 is provided between the outer peripheral edges 312*z* and 322*z* to conceal a gap between the swinging surfaces 312*a* and 322*a* facing each other; including the elastic member 33.

Figure 25B:
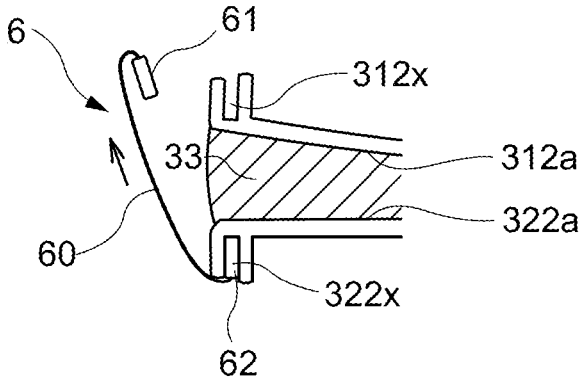
Figure 25C:
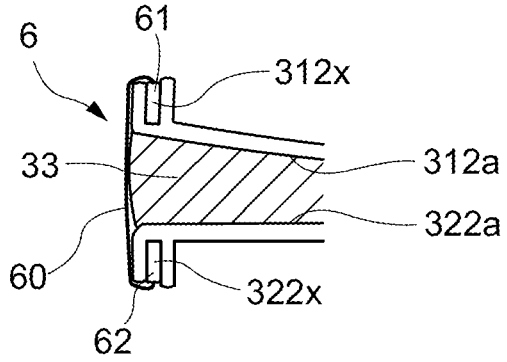

Specifically, grooves 312*x* and 322*x* extending along the outer peripheral edges 312*z* and 322*z* and opening in opposite directions are, provided in the vicinity of the outer peripheral edges 312*z* and 322*z* of the swinging surfaces 312*a* and 322*a* facing each other, and in the cover member 6, deformable strips $1 and 62 are attached to edge portions of the stretchable sheet material 60. As illustrated in FIGS. 25B and 25C, the strips 61 and 62 are sequentially pushed into the grooves 312*x* and 322*x* to be mounted to the grooves 312*x* and 322*x*. As a result, the cover member 8 conceals a gap between the upper base plate 312 and the lower base plate 322 which form facing swinging surfaces. The strips 61 and 62 may be mounted to the grooves 312*x* and 322*x* in any order.

For example, the stretchable sheet material 60 is formed by using a material obtained by knitting polyester fibers. In the present embodiment, the stretchable sheet material 60 is sewn or formed into a cylindrical shape, and the strips 61 and 62 made of resin and having an annular thin plate shape are integrally provided at the upper end and the lower end of the stretchable sheet material 60. The size and elasticity of the stretchable sheet material 60 are chosen so that no wrinkles are generated when the gap is most narrow and so that the stretchable sheet material 60 does not hinder the operation of the swinging surface when the gap is widened. The relationship between the grooves 312*x* and 322*x* and the strips 61 and 62 is one-to-one, and each of the strips 61 and 62 corresponds to the entire area of one of the grooves 312*x* and 322*x*, and the strips 81 and 62 are provided having a length that, surrounds the grooves 312 and 322$_x$. Needlessly to say, the material of the stretchable sheet material 60 is not limited to the above-described materials, and various materials such as cloth, upholstery, woven fabric, and knitted items can be used, as long as the material can be stretched and contracted and covers the inside. The stretchable sheet material 80 that can hide the inside is used, but the stretchable sheet material 60 may be a material through which the inside is slightly visible.

As illustrated in FIGS. 19, 20, and the like, when the upper base unit 31 moves with respect to the lower base unit 32, the cover member 6 follows the movement by deforming, in addition to stretching and contracting, according to the movement of the gap between the rolling surfaces 312*a* and 322*a* and continues to conceal the gap expanding and contracting between the upper base unit 31 and the lower base unit 32.

As illustrated in FIG. 1, the back 4 is provided with a back main body 42 at an upper end of a back support rod 41, and is attached to the seat 1 to swing together with the seat 1 as described above. Specifically, as illustrated in FIG. 5, a rear edge 132*a* of the outer seat shell 132 is provided with a flat insertion port 132*b* that opens rearward. On the other hand, a lower end front edge 41*a* of the back support rod 41 constituting the back 4 has a shape in accordance with the rear edge 132*a* of the outer seat shell 132, and an insertion unit 41*b* that can be inserted into the insertion port 132*b* of the outer seat shell 132 is provided. The insertion unit. 41*b* is inserted into the insertion port 132*b*, and then bolts (not illustrated) are inserted into bolt holes 132*c* and 41*c* to join the insertion unit 41*h* and the insertion port 132*b*. A wooden material is used for the back main body 42 of the present embodiment.

As illustrated in FIG. 1, the arms 5 are provided with arm rests 52 at upper ends of an arm rod 51, and are attached not to swing with respect to the seat 1 and the back 4 as described above. Specifically as illustrated in FIGS. 3 and 9, an arm mounting location 321*s* is set at a rear portion of the bottom surface of the support base unit 321 where the cocoon-shaped abutting plate 355 is not provided. On the other hand, the left and right arm rests 52 are connected by the arm rod 51, and a proximal end of the arm rod 51 is attached to a common bracket 53. The bracket 53 is arranged at the arm mounting location 321*s*, and a bolt. (not illustrated) is fastened through a hole 53*a* of the bracket 53 and a hole 321*h* provided in the bottom surface of the support base unit 321 from below. The arm rod 51 extends from this position to the left or right along the bottom surface of the seat 1, rises upward from the vicinity of the rear edge of the seat 1, and then extends forward. The arm rests 52 are arranged at the portions of the arm rod 51 extending forward.

As described above, the chair of the present embodiment includes swinging surfaces (rolling surfaces) 312*a* and 322*a* facing each other, and has a configuration in which the swinging surfaces 312*a* and 322*a* swings with respect to each other in directions of 360 degrees including the front-rear and left-right directions. In such a configuration, the elastic member 33 is arranged to be positioned between the swinging surfaces 312*a* and 322*a* at least in the vicinity of the outer peripheral edges 312*z* and 322*z*, and the stretchable sheet material 60 is provided between the outer peripheral edges 312*z* and 322*z* to conceal the gap between the swinging surfaces 312*a* and 322*a* facing each other, the gap including the elastic member 33.

Normally, when covering swinging surfaces facing each other, a wide, range including the swinging surfaces is covered by a cover and the cover is fixed to an appropriate location. In contrast, according to the present embodiment, the stretchable sheet material 60 is only arranged between the outer peripheral edges 312*z* and 322*z* of the swinging surfaces 312*a* and 322*a* facing each other, so that it is possible to conceal only a location that needs to be concealed. The elastic member 33 is arranged, in the vicinity of the outer peripheral edges 312*z* and 322*z*, between the swinging surfaces 312*a* and 322*a*, and the stretchable sheet material 60 conceals a space between the swinging surfaces 312*a* and 322*a*, the space including the elastic member 33. Therefore, the stretchable sheet material 60 and the elastic member 33 have a function of preventing foreign bodies from entering the space between the swinging surfaces 312*a* and 322*a*, and additionally, the elastic member 33 prevents the stretchable sheet material 60 from loosening or forming wrinkles, and the stretchable sheet material 60 has a function of preventing the elastic member 33 from protruding from the gap.

The size and elasticity of the stretchable sheet material 60 are chosen so that no wrinkles are generated when the gap is narrow and so that the stretchable sheet material Go does not hinder the operation of the swinging surfaces 312*a* and 322*a* when the gap is wide, and thus, it is possible to maintain an appropriate appearance of the stretchable sheet material 60.

The stretchable sheet material GO has a tubular shape, and thus, even if the swinging surfaces 312*a* and 322*a* swings with respect to each other in any direction of 360 degrees including the front-rear and left-right directions, the stretchable sheet material 60 can evenly cover the periphery of the gap.

The cover member 6 can deform to follow the movement of the gap between the swinging surfaces 312*a* and 322*a*, and thus, the cover member 6 does not affect the swing operation of the swinging surfaces 312*a* and 322*a* facing each other. Further, the cover member 6 has not only the ability of being stretched but also the ability of being deformed, and thus it is possible to realize a state where the movement can be followed more easily.

The above-described surfaces 312*a* and 322*a* facing each other are rolling surfaces that contact each other via the elastic member 33 and in which the surface 312*a* on the side of the upper base unit. 31 is curved and the contact portion between the upper base unit 31 and the lower base unit 32 changes by the swinging. Therefore, it is particularly necessary to prevent an object from being caught between the rolling surfaces 312*a* and 322*a*, and thus the cover member 6 having the above-described structure is particularly effective.

The elastic member 33 may be an annular member positioned only in the vicinity of the outer peripheral edges 312*z* and 322*z* of the swinging surfaces 312*a* and 322*a*. However, in the present embodiment, the elastic member 33 is a columnar body that is also arranged at an inner side from the vicinity of the outer peripheral edges 312*z* and 322*z*, and thus, the elastic member 33 may be formed thick to effectively achieve the above-described effect.

As a specific mounting structure, the grooves 312*x* and 322*x* extending along the outer peripheral edges 312*z* and 322*z* and opening in opposite directions are provided in the vicinity of the outer peripheral edges 312*z* and 322*z* of the swinging surfaces 312*a* and 322*a* facing each other, and the deformable strips 61 and 62 are attached to the edge portions of the stretchable sheet material 60 to form the cover member 6. Further, the strips 61 and 62 are pushed into the grooves 312*x* and 322*x*, so that the gap between the swinging surfaces 312*a* and 322*a* facing each other is concealed by the cover member 6. Therefore, it is easy to mount the cover member 6 and it is possible to maintain a state where the strips 61 and 62 do not easily detach from the grooves 312*x* and 322*x*, during swing.

In this case, each of the grooves 312*x* and 322*x* forms a pair together with a different one of the strips 61 and 62, and thus, the strips 61 and 62 can be arranged in a circular shape along the outer peripheral edges 312*z* and 322*z* and fitted into the grooves 312*x* and 322*x*. Therefore, it is possible to easily attach the cover member 6 and to easily maintain a stereoscopic shape of the cover member 6.

The embodiment of the present invention has been described, and a specific configuration of each unit is not limited to that in the embodiment described above and various modifications are possible without departing from the gist of the present invention.

REFERENCE SIGNS LIST

6 . . . Cover member
31 . . . Upper base unit
32 . . . Lower base unit
33 . . . Elastic member
60 . . . Stretchable sheet material
61, 62 . . . Strip
312*a*, 322*a* . . . Swinging surface trolling surface)
312*z*, 322*z* . . . Outer peripheral edge
312*x*, 322*x* . . . Groove
399*y* . . . Engaging claw

What is claimed is:

1. A chair comprising:

a first surface comprising a first peripheral edge, a second surface comprising a second peripheral edge, the second surface facing with the first surface, the second surface swinging with respect to the first surface such that the second surface tilts in any direction with respect to the first surface, an elastic member arranged between the first surface and the second surface at least in a vicinity of the first outer peripheral edge and the second outer peripheral edge, a stretchable sheet material provided between the first outer peripheral edge and the second outer peripheral edge to conceal a gap made between the first surface and the second surface, a first groove along the first peripheral edge, the first groove opening in a first direction, a second groove along the second peripheral edge, the second groove opening in a second direction opposite to the first direction, and two deformable strips provided at two opposing ends of the stretchable sheet material such that one of the strips is pushed into the second groove and the other of the strips is pushed into the first groove to conceal the gap made between the first surface and the second surface.

2. The chair according to claim 1, wherein a size and an elasticity of the stretchable sheet material are chosen so that no wrinkles are generated when the gap becomes narrow and an operation of the first surface and the second surface is not hindered when the gap becomes wide.

3. The chair according to claim 1, wherein the stretchable sheet material has a tubular shape.

4. The chair according to claim 1, wherein the stretchable sheet material deforms to follow a movement of the gap between the first surface and the second surface.

5. The chair according to claim 1, wherein the first surface contacts the second surface via the elastic member, and wherein the second surface is curved such that the closest point from the first surface to the second surface via the elastic member changes when the second surface swings.

6. The chair according to claim 1, wherein the elastic member 33 is arranged between the first surface and the second surface not only in the vicinity of the first outer peripheral edge and the second outer peripheral edge, but also inside the vicinity of the first outer peripheral edge and the second outer peripheral edge.

7. The chair according to claim 1, wherein said one of the strips is paired with the second groove and said the other of the strips is paired with the first groove.

* * * * *